US007155141B2

(12) United States Patent
Sato et al.

(10) Patent No.: US 7,155,141 B2
(45) Date of Patent: Dec. 26, 2006

(54) ELECTROPHOTOGRAPHIC IMAGE FORMING APPARATUS

(75) Inventors: Masaaki Sato, Shizuoka-ken (JP); Shigeo Miyabe, Numazu (JP); Hideki Kotsuka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 225 days.

(21) Appl. No.: 10/960,227

(22) Filed: Oct. 8, 2004

(65) Prior Publication Data

US 2005/0244188 A1 Nov. 3, 2005

(30) Foreign Application Priority Data

Apr. 28, 2004 (JP) ..... 2004-134624

(51) Int. Cl.
*G03G 21/18* (2006.01)

(52) U.S. Cl. ..... 399/114

(58) Field of Classification Search ..... 399/107, 399/110, 111, 112, 114
See application file for complete search history.

(56) References Cited

U.S. PATENT DOCUMENTS

| | | | | |
|---|---|---|---|---|
| 5,331,373 | A | 7/1994 | Nomura et al. | 355/200 |
| 5,452,056 | A | 9/1995 | Nomura et al. | 355/200 |
| 5,585,889 | A | 12/1996 | Shishido et al. | 355/200 |
| 5,839,028 | A | 11/1998 | Nomura et al. | 399/109 |
| 5,873,012 | A | 2/1999 | Miyabe et al. | 399/90 |
| 5,878,309 | A | 3/1999 | Nomura et al. | 399/111 |
| 5,911,096 | A | 6/1999 | Batori et al. | 399/111 |
| 5,926,666 | A | 7/1999 | Miura et al. | 399/25 |
| 5,940,658 | A | 8/1999 | Yokoi et al. | 399/119 |
| 5,943,529 | A | 8/1999 | Miyabe et al. | 399/111 |
| 5,946,531 | A | 8/1999 | Miura et al. | 399/111 |
| 5,950,047 | A | 9/1999 | Miyabe et al. | 399/111 |
| 5,966,566 | A | 10/1999 | Odagawa et al. | 399/109 |
| 5,974,288 | A | 10/1999 | Sato | 399/119 |
| 6,029,031 | A | 2/2000 | Yokomori et al. | 399/109 |
| 6,064,843 | A | 5/2000 | Isobe et al. | 399/111 |
| 6,075,957 | A | 6/2000 | Batori et al. | 399/114 |
| 6,128,452 | A | 10/2000 | Miyabe et al. | 399/90 |
| 6,173,140 | B1 | 1/2001 | Suzuki et al. | 399/113 |
| 6,185,390 | B1 | 2/2001 | Higeta et al. | 399/90 |
| 6,215,969 | B1 | 4/2001 | Nomura et al. | 399/111 |
| 6,282,390 | B1 | 8/2001 | Miyabe et al. | 399/111 |
| 6,317,572 | B1 | 11/2001 | Miyabe et al. | 399/111 |
| 6,351,620 | B1 | 2/2002 | Miyabe et al. | 399/111 |
| 6,640,066 | B1 | 10/2003 | Sato | 399/106 |

(Continued)

FOREIGN PATENT DOCUMENTS

JP 2002-148910 5/2002

(Continued)

*Primary Examiner*—Hoan Tran
(74) *Attorney, Agent, or Firm*—Fitzpatrick, Cella, Harper & Scinto

(57) ABSTRACT

A plurality of process cartridges are detachably mountable to an electrophotographic image forming apparatus along a substantially vertical line. The cartridges each have an electrophotographic photosensitive drum, process means actable on the drum, and a drum shutter movable between first and second positions. The apparatus includes mounting portions for detachably mounting the cartridges, an opening for permitting passage of the cartridges into the apparatus, a covering member for covering the opening, and a pressing member for moving the shutter to the second position thereof when the covering member moves from an open position to a closed position. An angle of rotation of the shutter rotated from the first to the second position in the bottommost cartridge is larger than an angle of rotation of the shutter rotated from the first position to the second position in another one of said process cartridges.

10 Claims, 17 Drawing Sheets

U.S. PATENT DOCUMENTS

| | | | | |
|---|---|---|---|---|
| 6,678,488 | B1 | 1/2004 | Toba et al. | 399/111 |
| 6,714,749 | B1 | 3/2004 | Sato et al. | 399/102 |
| 6,795,666 | B1 | 9/2004 | Miyabe et al. | 399/109 |
| 6,968,142 | B1 * | 11/2005 | Arimitsu et al. | 399/114 |
| 7,046,942 | B1 * | 5/2006 | Arimitsu et al. | 399/114 |
| 2002/0131790 | A1 | 9/2002 | Sato et al. | 399/111 |
| 2002/0159787 | A1 | 10/2002 | Chadani et al. | 399/109 |
| 2002/0191981 | A1 | 12/2002 | Miyabe et al. | 399/90 |
| 2003/0156856 | A1 | 8/2003 | Arimitsu | 399/114 |

FOREIGN PATENT DOCUMENTS

| | | |
|---|---|---|
| JP | 2003-241620 | 8/2003 |

* cited by examiner

ELECTROPHOTOGRAPHIC IMAGE FORMING APPARATUS

FIELD OF THE INVENTION AND RELATED ART

The present invention relates to an electrophotographic image forming apparatus in which a plurality of process cartridges having a drum shutter for protecting an electrophotographic photosensitive drum are removably mountable.

Here, an electrophotographic image forming apparatus is an image forming apparatus for forming an image on a recording medium with the use of an electrophotographic image forming method. The examples of an electrophotographic image forming apparatus include an electrophotographic copying machine, an electrophotographic printer (for example, a laser printer, an LED printer, etc.), a facsimile apparatus, a word processor, and a combination of two or more of the preceding apparatuses (multifunction printer, etc.).

A process cartridge is a cartridge which is removably mountable in the main assembly of an image forming apparatus, and in which a minimum of one among a charging means, a developing means, and a cleaning means, as processing means, and an electrophotographic photosensitive drum, are integrally placed so that they can be removably mountable in the main assembly of an image forming apparatus.

As one of the mechanisms, in accordance with the prior art, for opening or closing a drum shutter, there is a mechanism which uses the shutter arm(s) to retract the drum shutter 70 into the limited space between the process cartridge 7 and the front door 101 (Japanese Laid-open Patent Application 2003-241620).

There is another type of mechanism for opening or closing a drum shutter, which employs the shutter arm(s) connected to the drum shutter 70, and moves all the components of the shutter 70 all at once by moving the shutter arm(s) (Japanese Laid-open Patent Application 2002-148910).

In the field of an electrophotographic image forming apparatus, there is a strong desire, in recent years, for a smaller electrophotographic image forming apparatus, creating the problem that it is difficult to allocate a large space for a drum shutter.

In addition, in the case of an electrophotographic full-color image forming apparatus of an inline type, a plurality of process cartridges, different in the color component they develop, must be placed in a limited amount of space, which in turn makes it necessary to place the recording medium conveying portion and fixation station above and below the process cartridges, respectively, exacerbating the restriction regarding the space into which the drum shutter must be retracted.

SUMMARY OF THE INVENTION

The present invention solves the above-described problem, and its primary object is to provide an electrophotographic image forming apparatus substantially smaller in size than an electrophotographic image forming apparatus in accordance with the prior art.

Another object of the present invention is to provide an electrophotographic image forming apparatus, the recording medium conveyance path of which is substantially shorter than that of an electrophotographic image forming apparatus in accordance with the prior art.

According to an aspect of the present invention, there is provided an electrophotographic image forming apparatus for forming an image on a recording material, wherein a plurality of process cartridges are detachably mountable to the electrophotographic image forming apparatus along a substantially vertical line, the process cartridges each having an electrophotographic photosensitive drum, process means actable on the electrophotographic photosensitive drum, a drum shutter rotatably supported on a cartridge frame for movement between a first position for covering an exposure portion so as not to expose the electrophotographic photosensitive drum through the cartridge frame and a second position, retracted from the first position, for uncovering the exposure portion to expose the electrophotographic photosensitive drum, the apparatus including mounting portions for detachably mounting the process cartridges; an opening for permitting passage of said process cartridges into the image forming apparatus; a covering member for covering the opening movable between a close position for closing the opening and an open position, retracted from the close position, for opening the opening; a pressing member for moving and abutting to the drum shutter to move the drum shutter to the second position thereof when the covering member moves from the open position to the close position, wherein the angle of rotation of the drum shutter rotated by the pressing member from the first position to the second position in one of the process cartridges that takes a bottommost position among the process cartridges is larger than the angle of rotation of the drum shutter rotated by the pressing member from the first position to the second position in another one of the process cartridges.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described.

Embodiment 1

Figure 1:
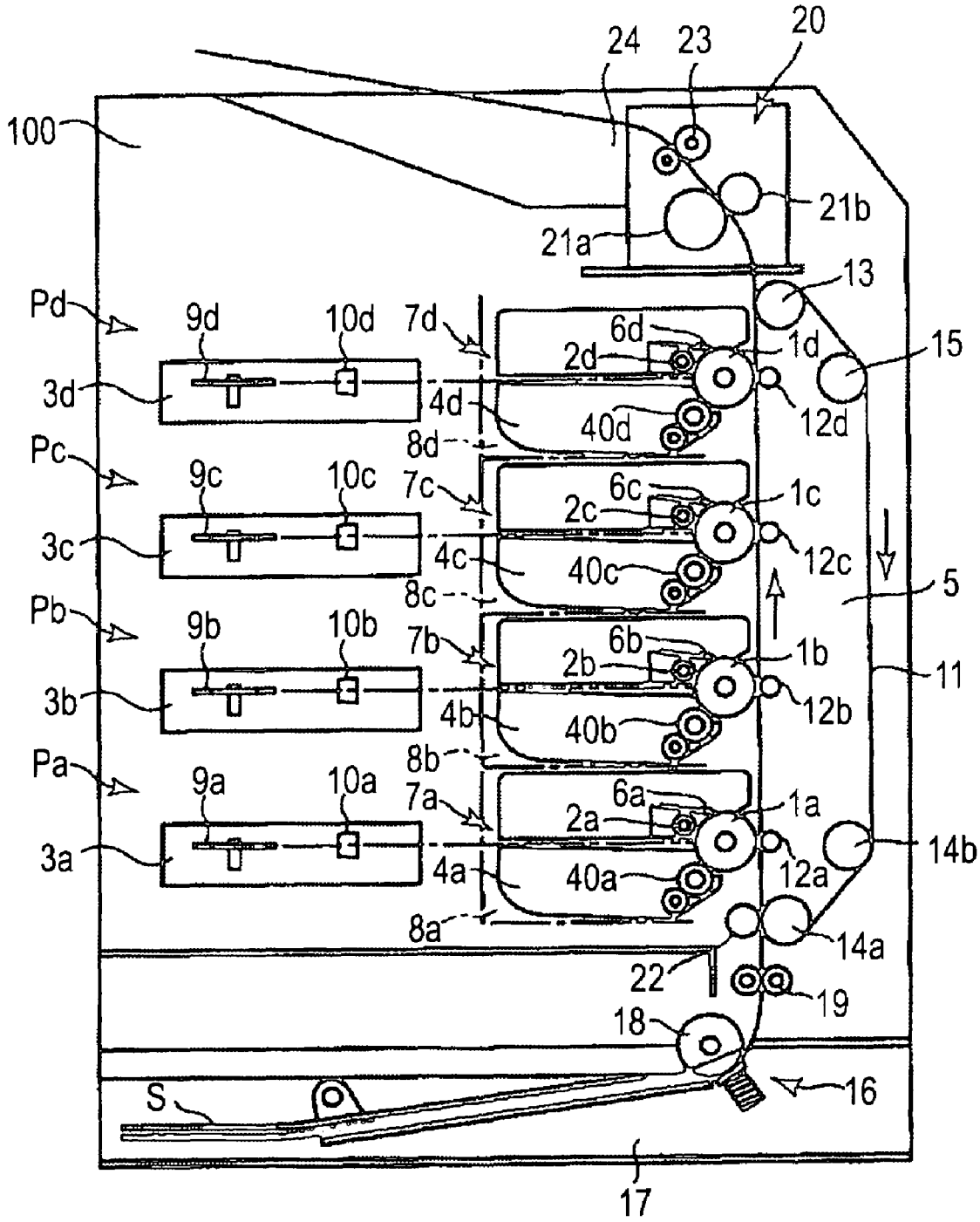
FIG. 1 is a schematic sectional view of the image forming apparatus in the first embodiment of the present invention, showing the general structure thereof.

FIG. 1 shows the overall structure of the electrophotographic image forming apparatus in the first embodiment of the present invention. First, referring to FIG. 1, the overall structure of the electrophotographic image forming apparatus will be described.

(Overall Structure of Electrophotographic Image Forming Apparatus)

Referring to FIG. 1, the electrophotographic image forming apparatus comprises: the main assembly 100, and a plurality (four in this embodiment) of image forming stations Pa, Pb, Pc, and Pd, which are vertically stacked in parallel. Each of the stations Pa, Pb, Pc, and Pd has the cartridge compartment (8*a*, 8*b*, 8*c*, and 8*d*), in which the process cartridge 7 (7*a*, 7*b*, 7*c*, and 7*d*) (which hereinafter will be referred to as "cartridge") is removably mounted.

Although the stations Pa, Pb, Pc, and Pd are vertically stacked in parallel in this embodiment, they may be stacked in parallel in a direction slightly angled relative to the true vertical direction.

Each cartridge 7 (7*a*, 7*b*, 7*c*, and 7*d*) is provided with an electrophotographic photosensitive member in the form of a drum (which hereinafter will be referred to as "photosensitive drum") 1 (1*a*, 1*b*, 1*c*, and 1*d*). The photosensitive drum 1 is rotationally driven by a driving means (unshown) in the counterclockwise direction in FIG. 7. In the adjacencies of the peripheral surface of the photosensitive drum 1, there are a charging means 2 (2*a*, 2*b*, 2*c*, and 2*d*) for uniformly charging the peripheral surface of the photosensitive drum 1, a scanner unit (3*a*, 3*b*, 3*c*, and 3*d*) for projecting a beam of laser light, while modulating the beam of laser light with image formation data, onto the peripheral surface of the photosensitive drum 1 to form an electrostatic latent image on the peripheral surface of the photosensitive drum 1, a developing means 4 (4*a*, 4*b*, 4*c*, and 4*d*) for developing the latent image into a visible image (formed of toner) by adhering toner to the latent image, a conveyer belt unit 5 as an electrostatic transferring apparatus for transferring the toner image on the photosensitive drum 1 onto a recording medium S, and a cleaning means 6 (6*a*, 6*b*, 6*c*, and 6*d*) for removing the toner remaining on the peripheral surface of the photosensitive drum 1 after the transfer of the toner image, listing in the order of the image formation steps they are involved.

In this embodiment, the photosensitive drum 1, the charging means (processing means) 2, the developing means (processing means) 4, and the cleaning means (processing means) 6 are integrally placed in a cartridge removably mountable in the main assembly of the image forming apparatus, constituting the process cartridge 7. The cartridge 7 is provided with a drum shutter 70 (FIG. 2) for protecting the area of the photosensitive drum 1 which is to be exposed. In FIG. 1, however, the drum shutter 70 is not illustrated, in order to make the drawing easier to understand.

Next, referring to FIG. 2, the process cartridge 7 will be described in more detail.

The photosensitive drum 1 (1*a*, 1*b*, 1*c*, and 1*d*) comprises an aluminum cylinder, for example, and a layer of photosensitive substance coated on the peripheral surface of the aluminum cylinder. The photosensitive drum 1 is rotatably supported by a pair of supporting members, by its lengthwise ends. To one of the lengthwise ends of the photosensitive drum 1, the driving force from a motor (unshown) is transmitted to rotationally drive the photosensitive drum 1 in the counterclockwise direction.

The charging means 2 (2*a*, 2*b*, 2*c*, and 2*d*) uses a contact charging method. The charging means 2 is an electrically conductive roller, the peripheral surface of which is placed in contact with the peripheral surface of the photosensitive drum 1. The peripheral surface of the photosensitive drum 1 is uniformly charged by applying a charge bias voltage to the roller 2.

The scanner unit (3*a*, 3*b*, 3*c*, and 3*d*) comprises a laser diode (unshown), a polygon mirror (9*a*, 9*b*, 9*c*, 9*d*) which is rotated at a high speed, an image formation lens (10*a*, 10*b*, 10*c*, 10*d*), etc. A beam of image formation light modulated with video signals is projected from the laser diode, deflected (reflected) by the polygon mirror being rotated at a high speed, and focused on the charged peripheral surface of the photosensitive drum 1 through the image formation lens. As a result, numerous points of the charged peripheral surface of the photosensitive drum 1 are selectively exposed, forming an electrostatic latent image, which reflects the video signals, on the peripheral surface of the photosensitive drum 1.

The developing means 4 (4*a*, 4*b*, 4*c*, and 4*d*) have a toner container 41 in which toners of yellow, magenta, cyan, or black color, is stored, respectively. The developing means sends the toner in the toner container 41 to the toner supply roller 43, by the toner moving mechanism 42.

The toner supply roller 43 is rotated in the direction indicated by an arrow mark Z to supply the development roller 40 with toner, and also, to strip from the development roller 40 the toner remaining on the development roller 40 after the development of the latent image on the photosensitive drum 1.

After being supplied to the development roller 40, the toner is coated, while being triboelectrically charged, by the development blade 44 kept in contact with the peripheral surface of the development roller 40, on the peripheral surface of the development roller 40, which is being rotated in the direction indicated by an arrow mark Y. Then, as the development bias is applied to the development roller 40, the peripheral surface of which opposes the peripheral surface of the photosensitive drum 1 on which the latent image has just been formed, the toner is adhered to the peripheral surface of the photosensitive drum 1 in the pattern of the latent image; the latent image is developed by the toner.

The conveyer belt unit 5 is provided with the electrostatic transfer belt 11 (which hereinafter will be referred to as transfer belt 11), which is circularly driven, with the outward surface of which remaining in contact with all of the photosensitive drums 1 (1*a*, 1*b*, 1*c*, and 1*d*). As the material for the electrostatic transfer belt 11, a single-layer resin film, a multilayer resin film made up of a substrate layer formed of rubber, and a layer of resin film layered on the substrate layer is used. The electrostatic transfer belt 11 is wrapped and stretched around the driver roller 13, follower rollers 14*a* and 14*b*, and tension roller 15. It electrostatically holds the recording medium S to the outward surface thereof (surface on the left side in the drawing), and is circularly driven to place the recording medium S in contact with the peripheral surface of each photosensitive drum 1. With this movement of the electrostatic transfer belt 11, the recording medium S is conveyed by the transfer belt 11 to the transfer station in which the toner image on the photosensitive drum 1 is transferred onto the recording medium S.

Within the loop formed by the transfer belt 11, four transfer rollers (12*a*, 12*b*, 12*c*, and 12*d*) are placed in the positions in which they remain in contact with the inward surface of the transfer belt 11, in terms of the loop, with the transfer belt 11 remaining pinched between the four photosensitive drums 1 (1*a*, 1*b*, 1*c*, and 1*d*) and the transfer rollers (12*a*, 12*b*, 12*c*, and 12*d*). To these transfer rollers, bias with the positive polarity is applied during the transfer process, and therefore, electrical charge with the positive polarity is applied to the recording medium S through the transfer belt 11, generating an electric field. By this electric field, the toner images on the photosensitive drums 1, which are negative in polarity, are transferred onto the recording medium S while the recording medium S is in contact with each of the photosensitive drums 1.

The recording medium feeding station 16 is the station from which the recording medium S is conveyed to each image forming station. It has a cassette 17 in which a plurality of recording media S are stored. During an image forming operation, the feed roller (semicylindrical roller) 18, and a pair of registration rollers 19, are rotationally driven in synchronism with the progression of the image forming operation, feeding the recording media S into the apparatus main assembly, while separating them one by one. Each recording medium S is temporarily kept on standby, remaining slightly bowed upward, by the registration roller 19, as its leading edge comes into contact with the registration rollers 19. Then, it is released in synchronism with the rotation of the transfer belt 11 and the leading edge of the image formed on the photosensitive drum 1, and then, is conveyed to the transfer belt 11, by the pair of registration rollers 19.

The fixation station 20 is the station in which the plurality of toner images which are different in color and have just been transferred onto the recording medium S are fixed to the recording medium S. The fixation station 20 comprises: a rotational heat roller 21*a*, and a pressure roller 21 kept pressed against the heat roller 21*a* to apply heat and pressure to the recording medium S. More specifically, the recording medium S onto which the toner images have been just transferred from the photosensitive drums 1 is conveyed through the fixing station 20 by the pressure roller 21*b*, and while the recording medium S is conveyed through the fixation station 20, heat and pressure are applied to the recording medium S by the heat roller 21*a*, causing the plurality of toner images different in color to be fixed to the surface of the recording medium S.

As for the image forming operation, first, the cartridges 7 (7*a*, 7*b*, 7*c*, and 7*d*) are sequentially driven in synchronism with the image formation timing (in the counterclockwise direction), rotating sequentially the photosensitive drums 1 (1*a*, 1*b*, 1*c*, and 1*d*), and the scanner units, which correspond to the cartridges 7 one for one, are sequentially driven. As the photosensitive drum 1 is driven, the charge roller 2 uniformly charges the peripheral surface of the photosensitive drum 1, and the scanner unit exposes the peripheral surface of the photosensitive drum 1 in response to video signals, forming thereby an electrostatic latent image on the peripheral surface of the photosensitive drum 1. Each of the development rollers 40 as developing means 4 forms a toner image (image formed of toner) by transferring toner onto the numerous points of the electrostatic latent image (it develops the electrostatic latent image).

Meanwhile, the registration rollers 19 begin to be rotated, conveying the recording medium S to the transfer belt 11, so that the timing with which the leading edge, in terms of the moving direction of the transfer belt 11, of the toner image formed on the peripheral surface of the most upstream photosensitive drum 1 is brought to the contact area between the photosensitive drum 1 and transfer belt 11, by the rotation of the photosensitive drum 1, coincides with the timing with which the theoretical line on the recording medium S, at which the transfer of the toner images onto the recording medium S is to begin, is brought to the contact area.

The recording medium S is electrostatically adhered to the outward surface of the transfer belt 11 as it is conveyed between the most upstream transfer roller 14*a*, and an electrostatic adhesion roller 22 kept pressed again the most upstream transfer roller 14*a*, while remaining pinched between the electrostatic adhesion roller 22 and transfer belt 11. In addition, electrical voltage is applied between the transfer belt 11 and roller 22, inducing electrical charge between the recording medium S, which is a dielectric medium, and the dielectric layer of the transfer belt 11, electrostatically adhering the recording medium S to the outward surface of the transfer belt 11. Therefore, it is assured that the recording medium S is adhered to the transfer belt 11, and remains adhered thereto until it is conveyed to the most downstream transfer station.

While the recording medium S is conveyed as described above, the toner image on each of the photosensitive drums 1 is sequentially transferred onto the recording medium S by the electric field formed by the photosensitive drum 1 and transfer roller 12.

After the transfer of the four toner images different in color onto the recording medium S, the recording medium S is separated from the transfer belt 11 by the curvature of the driver roller 13, and is conveyed into the fixation station 20, in which the aforementioned toner images are thermally fixed to the recording medium. Then, the recording medium S is discharged from the apparatus main assembly by a pair of discharge rollers 23 through the recording medium outlet 24.

(Structure of Process Cartridge)

Next, referring to FIGS. 2 and 3, the process cartridge in accordance with the present invention will be described.

Figure 2:
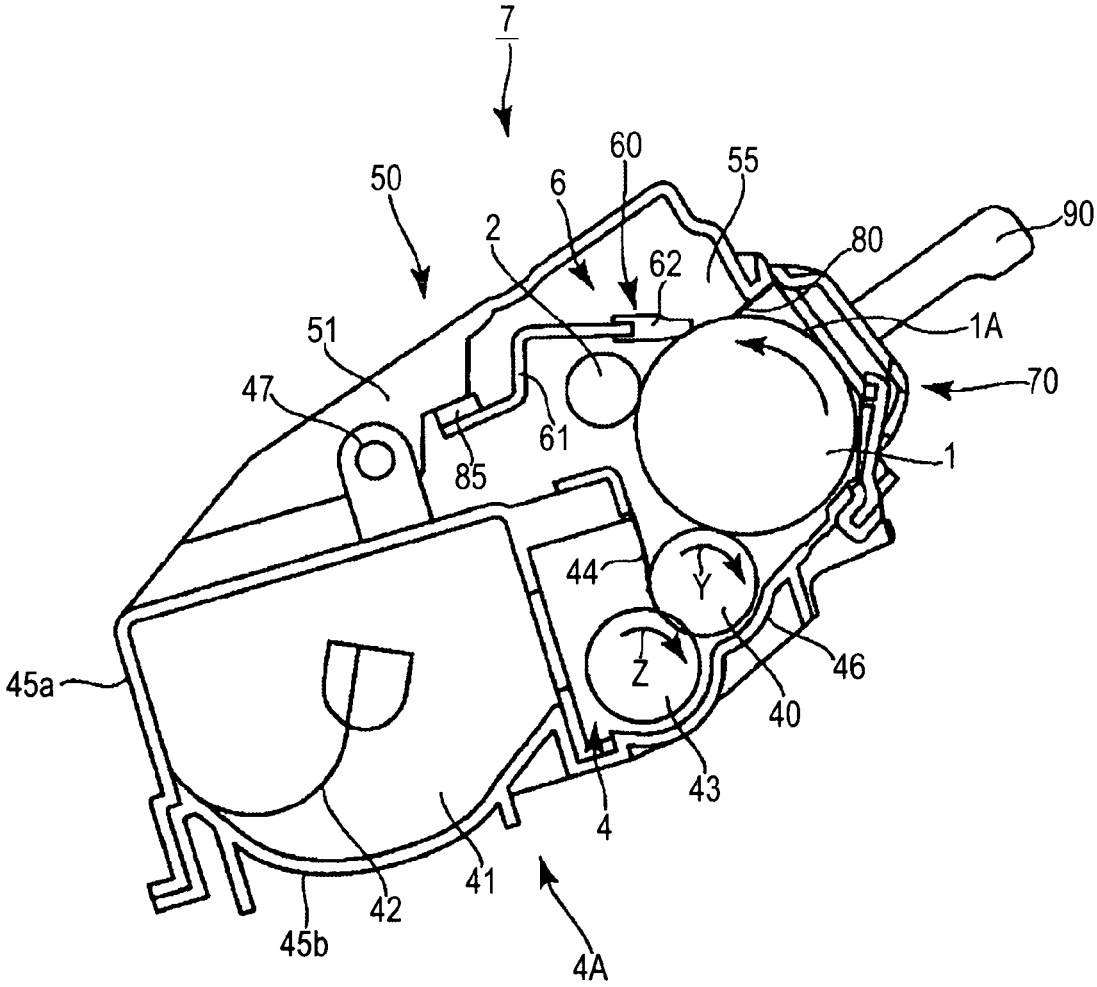
FIG. 2 is a schematic sectional view of the process cartridge removably mountable in the image forming apparatus in accordance with the present invention.
Figure 3:
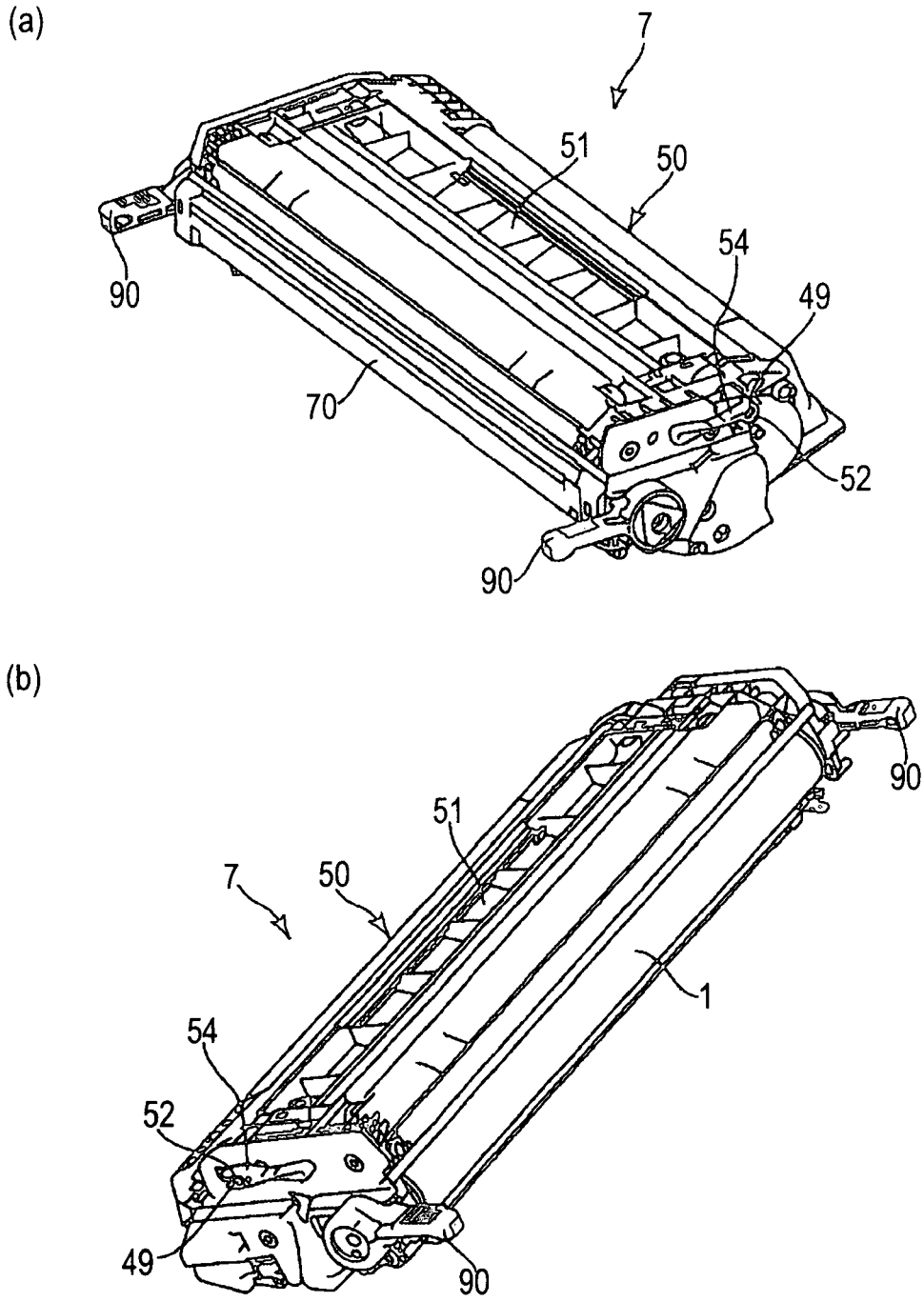
FIGS. 3(*a*) and 3(*b*) are perspective views of the process cartridge, FIG. 3(*a*) and FIG. 3(*b*) showing the process cartridge as seen from diagonally upward of the right front, and diagonally upward of the left front, respectively.

FIG. 2 is a sectional view of the cartridge 7 which contains the toner, at a plane perpendicular to the lengthwise direction of the cartridge 7, and FIGS. 3(*a*) and 3(*b*) are perspective views of the cartridge 7 shown in FIG. 2. The cartridges 7*a*, 7*b*, 7*c*, and 7*d* which contain yellow, magenta, cyan, and black toners, respectively, are the same in structure.

In this embodiment, the cartridge 7 is made up of the cleaner unit 50 and a development unit 4A. The cleaner unit 50 comprises the photosensitive drum 1, the charging means 2, and the cleaning means 6, whereas the development unit 4A comprises the developing means for developing an electrostatic latent image on the peripheral surface of the photosensitive drum 1.

To the cleaning means frame 51 of the cleaner unit 50, the photosensitive drum 1 is rotatably attached, with the interposition of a pair of bearings (unshown).

In the adjacencies of the peripheral surface of the photosensitive drum 1, the charging means 2 for uniformly charging the photosensitive layer, that is, the outermost layer, of the photosensitive drum 1, and the cleaning blade 60 as the cleaning means 6 for removing the developer (residual toner) remaining on the peripheral surface of the photosensitive drum 1 after the image transfer, are placed; they are placed in contact with the peripheral surface of the photosensitive drum 1. After being removed from the peripheral surface of the photosensitive drum 1 by the cleaning blade 60, the residual toner (removed toner) is stored in the removed developer storage chamber 55, which is an integral part of the cleaning means frame 51.

The development unit 4A has a developing means frame (made up of sub-frames 45*a* and 45*b*) in which toner is stored. The developer means sub-frames 45*a* and 45*b* are joined (by ultrasonic welding or the like), forming the developer container unit 46.

The development roller 40 is supported by the developer container unit 46, with the interposition of a pair of bearings, so that the development roller 40 is rotatable (direction indicated by arrow mark) with the presence of a minute gap between the peripheral surfaces of the development roller 40 and photosensitive drum 1. The developing means 4 comprises the developer supply roller 43 and the development blade 44, which are placed in contact with the peripheral surface of the photosensitive drum 1. The developer supply roller 43 is rotated in contact with the peripheral surface of the development roller 40. The developing means 4 also comprises the toner conveyance mechanism 42, which is placed within the developer container unit 46 to convey the stored toner to the supply roller 43 while stirring the toner.

The development unit 4A is provided with a pair of connective holes 47, which are located at the lengthwise ends of the container unit 46, one for one, whereas the cleaning means frame 51 of the cleaner unit 50 is provided with a pair of supportive holes 52, which are located at the length ends of the cleaning means frame 51. The development unit 4A and the cleaner unit 50 are connected to each other by inserting, from the outward of the two units, a pair of pins 49 through the connective holes 47 and supportive holes 52 while holding the two units so that the connective holes 47 and supportive holes 59 align one for one. As a result, the entirety of the development unit 4A becomes rotatable about the pins 49, being thereby movable relative to the cleaner unit 50.

Further, the development unit 4A is kept pressured by a pair of springs (unshown) in the direction to rotate the development unit 4A about the pins 49 so that the development roller 40 is kept in contact with the photosensitive drum 1.

During a developing operation, the toner in the toner container 41 is conveyed by the stirring mechanism 42 to the supply roller 43, which is being rotated (in direction indicated by arrow mark Y) in contact with the development roller 40 which is being rotated (in direction indicated by arrow mark Z). As a result, the peripheral surface of the supply roller 43 is rubbed against the peripheral surface of the development roller 40, causing the toner on the peripheral surface of the supply roller 43 to be supplied (adhered) to the peripheral surface of the development roller 40. The toner having adhered to the peripheral surface of the development roller 40 is brought by the rotation of the development roller 40 to the location at which the development blade is in contact with the peripheral surface of the development roller 40. Thus, as the development roller 40 is further rotated, the layer of the toner on the peripheral surface of the development roller 40 is regulated in thickness by the development blade, into a thin layer of the toner uniform in thickness, while being given a predetermined amount of electric charge. Then, the thin layer of the toner on the peripheral surface of the development roller 40 is brought by the further rotation of the development roller 40 to the development station, in which the distance between the photosensitive drum 1 and development roller 40 is extremely small. In the development station, the toner from the thin layer of the toner on the peripheral surface of the development roller 40 is adhered to the electrostatic latent image on the peripheral surface of the photosensitive drum 1, by the development bias applied to the development roller 40 from the electrical power source (unshown); in other words, the development roller 40 develops the latent image. The toner which did not contribute to the development of the latent image, that is, the toner remaining on the development roller 40 after the image transfer, is returned by the further rotation of the development roller 40, into the container unit 46, in which it is stripped from the development roller 40 by the supply roller 43 in the area in which the peripheral surfaces of the supply roller 43 and development roller 40 are rubbing against each other, in other words, the residual toner is recovered into the container unit 46. The recovered toner is mixed into the toner in the container unit 46 by the stirring mechanism 42.

(Method for Mounting Process Cartridge into Image Forming Apparatus Main Assembly and Removing it Therefrom)

Next, referring to FIG. 4, the method for mounting the cartridge 7 into the apparatus main assembly 100 and removing it therefrom will be described.

Figure 4:
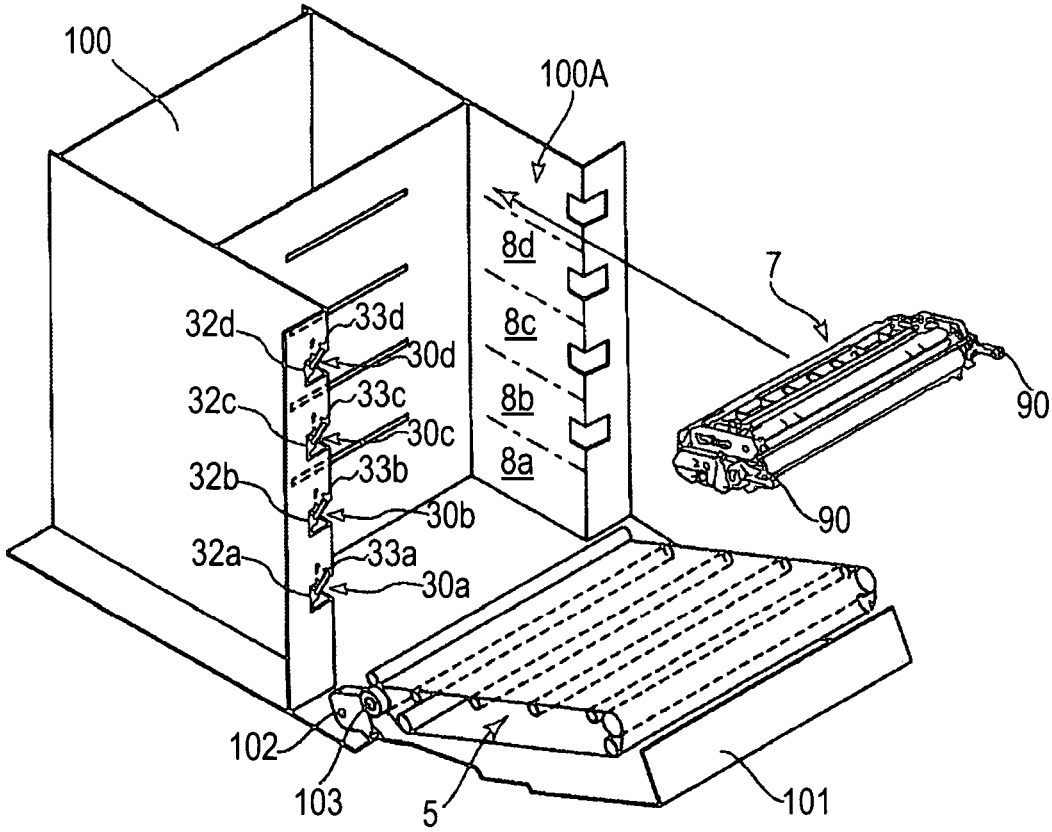
FIG. 4 is a perspective view of the main assembly of the image forming apparatus, and process cartridge, showing the relationship among the process cartridge, front door of the main assembly, and recording medium conveyance belt unit.

Referring to FIG. 4, the apparatus main assembly 100 is provided with a hinged door 101 for covering the opening 100A of the apparatus main assembly 100. The door 101 is hinged to the apparatus main assembly 100 so that it can be rotated about the door supporting shaft 102. The apparatus main assembly 100 is also provided with a conveyer belt unit 5 (which hereinafter will be referred to simply as unit 5), which is attached to the hinged door 101. Thus, as the hinged door 101 is opened or closed, the unit 5 is also rotated about the door supporting shaft 102.

In other words, the hinged door 101 can be rotationally moved, along the unit 5, between the position in which it cover the opening 10A, and the position into which it retracts to expose the opening When the hinged door 101 is open, and therefore, the unit 5 is away from the apparatus main assembly 100, the cartridge 7 can be mounted into the apparatus main assembly 100 or removed therefrom. The cartridge 7 is provided with a pair of handles 90, making it easier for an operator to handle the cartridge 7 during the mounting or removal of the cartridge 7. The pair of handles 90 are located near the lengthwise ends of the cartridge, one for one, at which the photosensitive drum 1 is supported.

The apparatus main assembly 100 is provided with a cartridge compartment (chamber) which is divided into four sections 8*a*, 8*b*, 8*c*, and 8*d*, one for each image forming station, by the provision of guide rails (unshown) (FIG. 4). The cartridge 7 is to be mounted into the apparatus main assembly 100, or removed therefrom, with the guides 54 (FIG. 3) of the cartridge 7 engaged with the guide rails of the cartridge chamber so that the cartridge 7 can be precisely positioned relative to the apparatus main assembly 100.

(Opening or Closing of Drum Shutter)

Next, referring to FIGS. 5 and 6, the opening or closing of the drum shutter 70 (which hereinafter will be referred to as shutter 70) in the first embodiment of the present invention will be described.

The developer image formed on the photosensitive drum 1 is transferred by the unit 5 onto a recording medium S, during the image forming operation. Therefore, during the image forming operation, the peripheral surface of the photosensitive drum 1 remains partially exposed; in other words, there is an exposed portion A, or the portion which is not covered with the cartridge frame, more specifically, the developing means frame and cleaning means frame 51, as shown in FIG. 2. Therefore, the cartridge 7 is provided with the shutter 70 which keeps the portion 1A of the photosensitive drum 1 covered when the cartridge 7 is not in the cartridge compartment.

The shutter 70 is structured so that it can be moved between the first position in which it completely covers the portion 1A of the photosensitive drum 1, and the second position into which it retracts to expose the portion 1A of the photosensitive drum 1. Ordinarily, the shutter 70 is formed of resin. However, the material for the shutter 70 does not need to be limited to resin.

Figure 5:
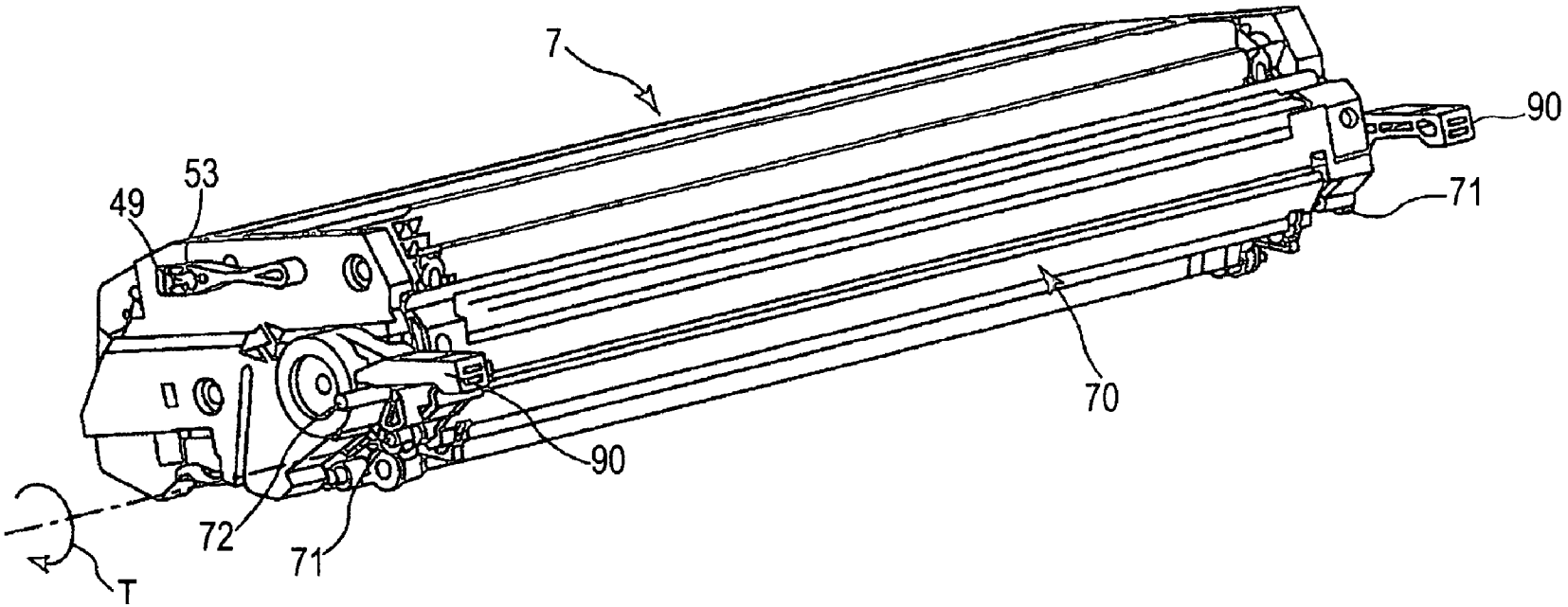
FIG. 5 is a perspective view of the process cartridge, the drum shutter of which is in the closed position.
Figure 6:
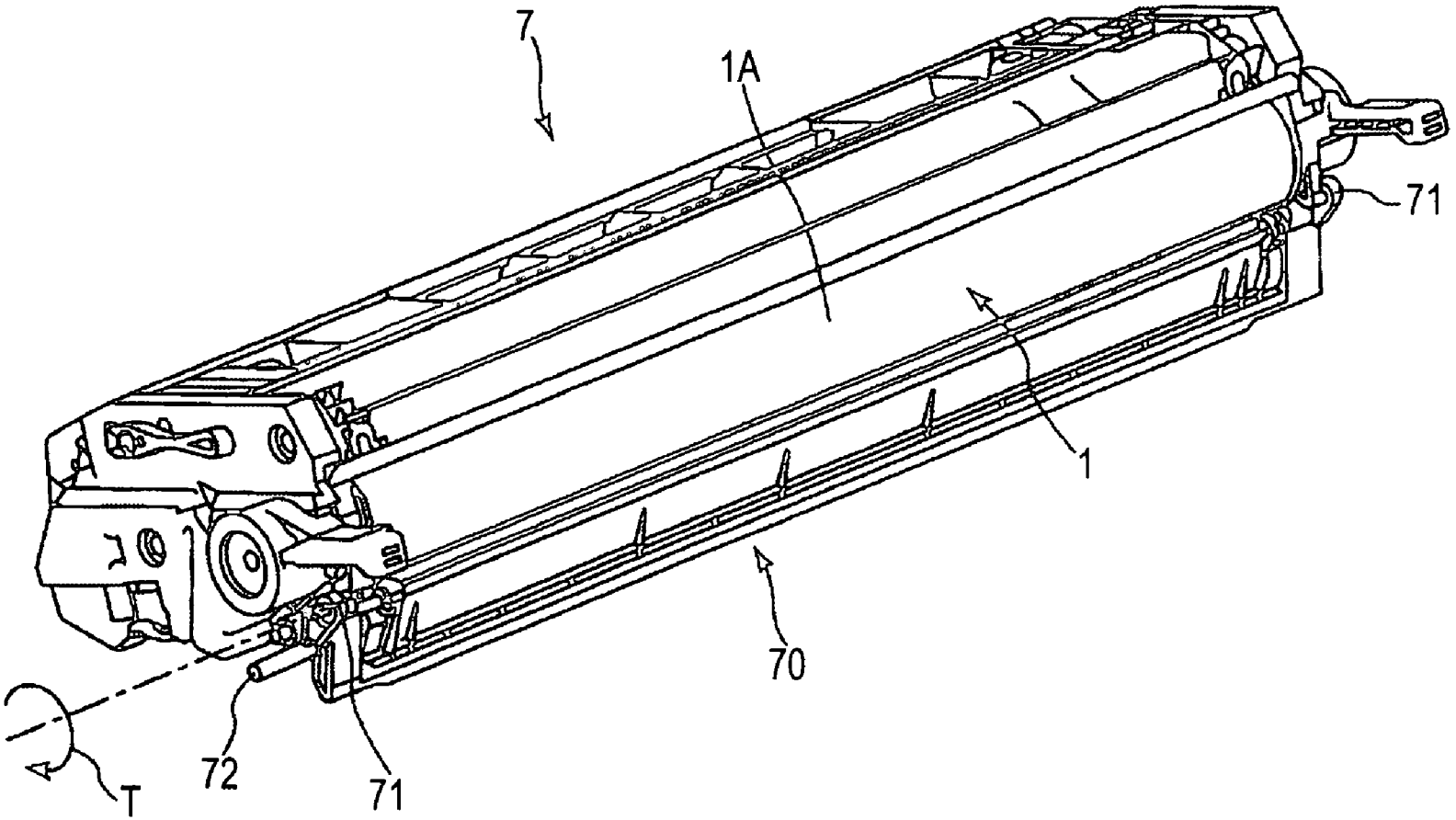
FIG. 6 is a perspective view of the process cartridge, the drum shutter of which is in the open position.

FIG. 5 shows the cartridge 7, the shutter of which is in the first position in which it covers the photosensitive drum 1, whereas FIG. 6 shows the cartridge 7, the shutter of which has retracted into the second position in which it exposes the portion 1A of the photosensitive drum 1.

Referring to FIGS. 5 and 6, the shutter 70 is rotatably supported by a pair of shutter supporting portions 71 and 71 located at the lengthwise ends of the cartridge 7, being enabled to be rotated about the shutter supporting portions 71 and 71 in the direction indicated by an arrow mark T (clockwise direction) to be moved from the closed position (FIG. 5) in which it covers the photosensitive drum 1, to the open position (FIG. 6) into which it retracts.

Also referring to FIGS. 5 and 6, one end of the shutter 70, in terms of the lengthwise direction of the cartridge 7, is provided with a pin 72 for opening or closing the shutter 70.

In this embodiment, the shutter supporting portions 71 are located at the bottom of the cartridge 7. In other words, the cartridge 7 is structured so that the shutter 70 is opened downward as shown in FIG. 6. However, the shutter supporting portions 71 may be located at the top of the cartridge 7 so that the shutter 70 is opened upward.

Referring to FIGS. 4, and 7–9, a lever as a means for triggering the opening or closing of the shutter 70 of the cartridge 7 as the cartridge 7 is inserted into the apparatus main assembly 100 will be described (hereinafter, lever will be referred to as trigger 30).

Figure 9:
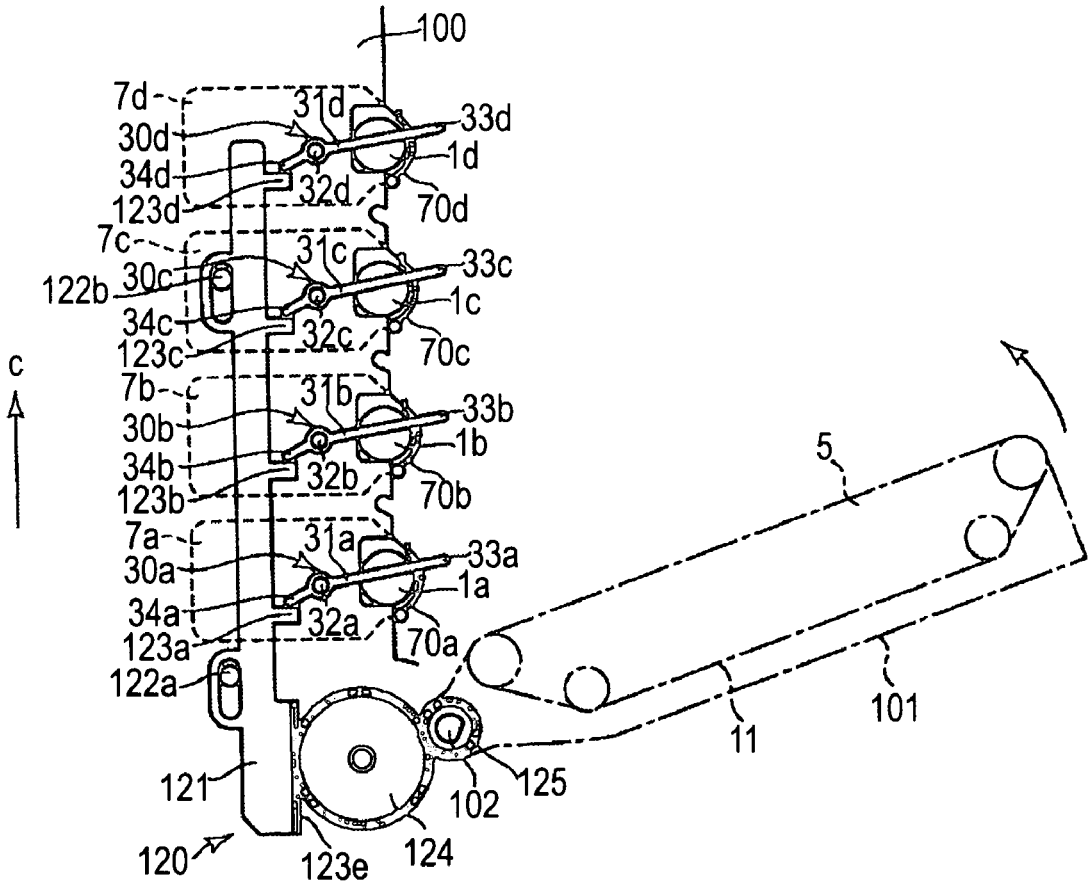
FIG. 9 is a perspective drawing for illustrating the movements of the shutter trigger, and mechanism, for opening or closing the drum shutter of the process cartridge.

FIG. 9 shows the hinged door 101, which is open to allow the cartridge 7 to be inserted into the cartridge compartment (8*a*, 8*b*, 8*c*, and 8*d*) through the opening 100A of the apparatus main assembly 100.

Figure 8:
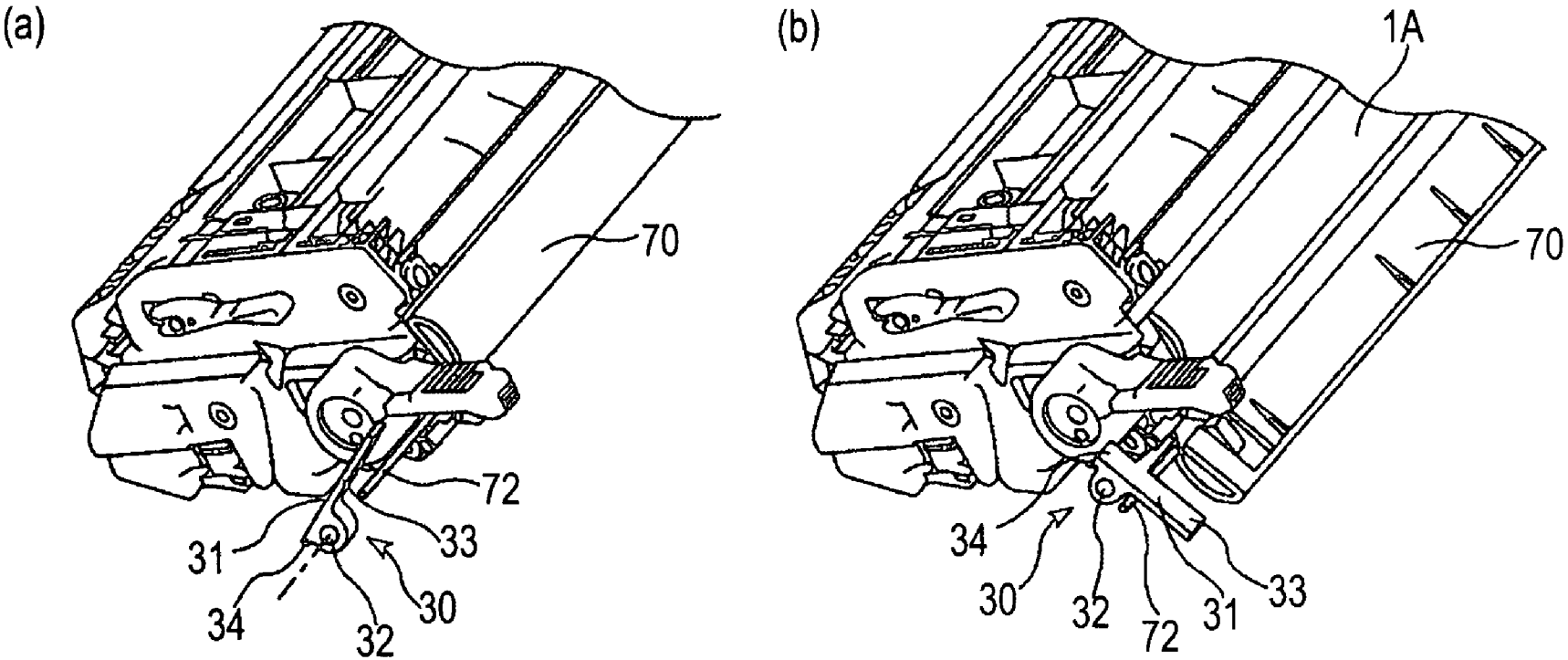
FIGS. 8(*a*) and 8(*b*) are perspective views for showing the movement of the shutter trigger for opening or closing the drum shutter of the process cartridge.

The triggers 30 (30*a*, 30*b*, 30*c*, and 30*d*) are provided on the apparatus main assembly side. Each trigger 30 is provided with a lever 31 (31*a*, 31*b*, 31*c*, and 31*d*) rotatably supported by a shaft 32 (32*a*, 32*b*, 32*c*, and 32*d*) attached to the apparatus main assembly 100. When the hinged door 101 is in the open position, the front portion 33 (33*a*, 33*b*, 33*c*, and 33*d*), that is, the portion on the front side of the shaft 32, of the lever 31 points upward, as shown in FIGS. 4 and 8(*a*), whereas the rear end 34 (34*a*, 34*b*, 34*c*, and 34*d*), that is, the end opposite to the front end, projects toward the mechanism 120 for opening or closing the shutter 70 (which hereinafter will be referred to simply as the shutter mechanism 120).

Figure 7:
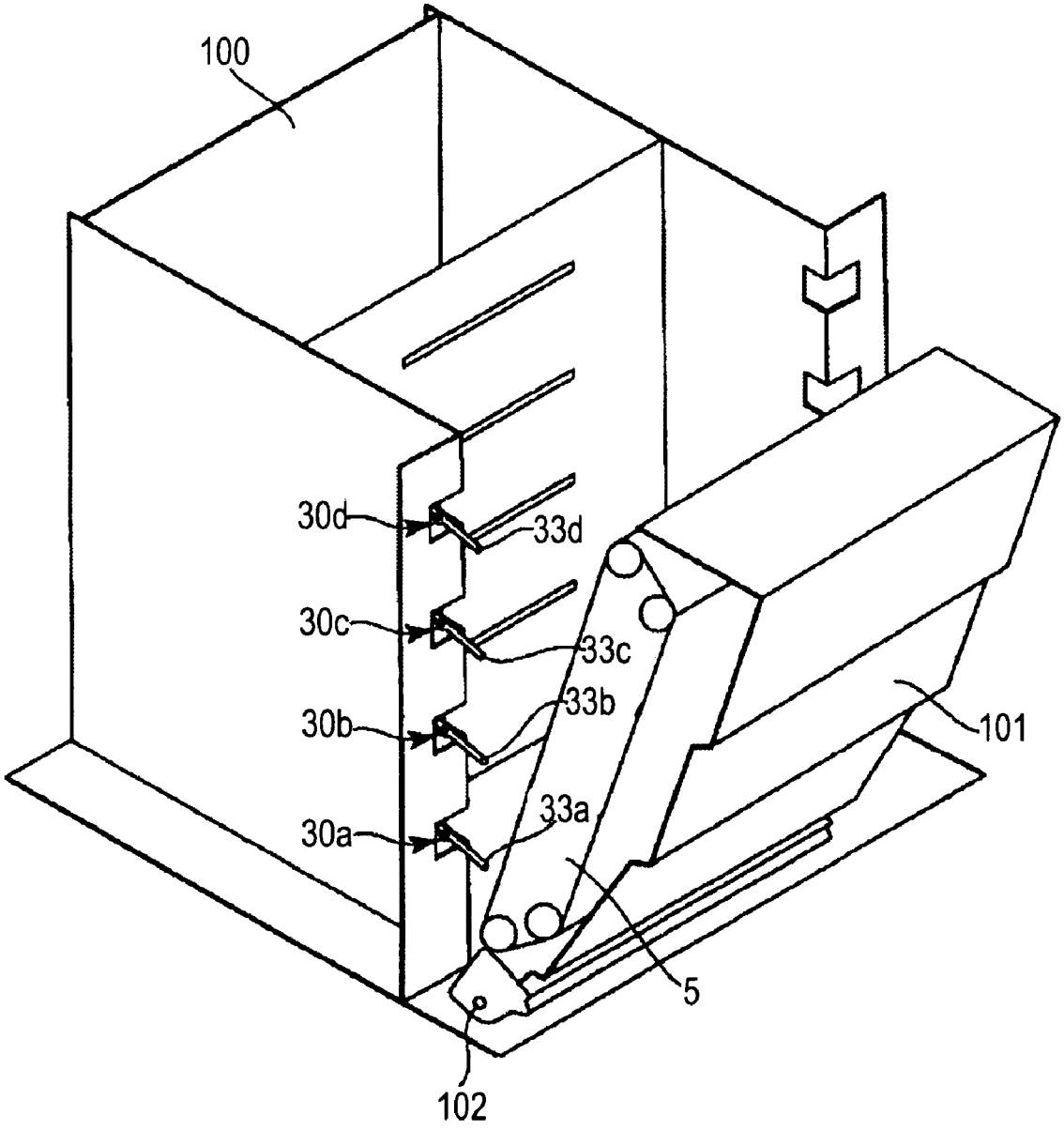
FIG. 7 is a perspective drawing for describing the relationship among the main assembly of the image forming apparatus, the process cartridge, the front door of the main assembly, and the recording medium conveyance belt unit.

As the hinged door 101 in the state shown in FIG. 4 is closed, the trigger 30 is rotated in the clockwise direction by the shutter mechanism 120 (FIG. 9) located between the hinged door 101 and trigger 30. As a result, the trigger 30 is made to point downward as shown in FIGS. 7 and 8(*b*).

Next, referring to FIG. 9, the shutter mechanism 120 in this embodiment will be described.

The shutter mechanism 120 as a shutter opening means in this embodiment is provided with a trigger moving member 121 in the form of a rod, which is supported by a pair of shafts 122*a* and 122*b* so that the trigger moving member 121 can be vertically moved upward or downward. The trigger moving member 121 is provided with four projections (123*a*, 123*b*, 123*c*, and 123*d*), which project from the front surface of the member 121. The trigger moving member 121 is also provided with a rack portion 123*e*, which is located below the bottommost projection 123*a*: the rack portion 123*e* constitutes the bottommost end of the trigger moving member 121.

The lever 31 of the trigger 30 is kept under the pressure generated by a pressure generating means (unshown) in the direction to rotate the lever 31 in the counterclockwise direction, in FIG. 9, about the shaft 32. Therefore, the rear end portion 34 (34*a*, 34*b*, 34*c*, and 34*d*) remains in contact with the top surface of the corresponding projection (123*a*, 123*b*, 123*c*, and 123*d*).

The rack portion 123*e*, or the bottommost portion, of the trigger moving member 121, is meshed with an idler gear 124, which is meshed with a gear 125 fitted around the shaft 102 which rotationally supports the hinged door 101.

With the provision of the above-described structural arrangement, as the hinged door 101 is closed, the unit 5 in the state shown in FIG. 9 is rotated in the counterclockwise direction, causing the gear 125 to be rotated in the counterclockwise direction. As a result, the idler gear 124 meshed with the gear 125 is rotated in the clockwise direction, moving the trigger moving member 121 having the rack portion 123*e* meshed with the gear 124, in the direction indicated by an arrow mark C.

As the trigger moving member 121 is moved in the abovementioned direction, its projections (123*a*, 123*b*, 123*c*, and 123*d*), which are in contact with the rear end portions 34 (34*a*, 34*b*, 34*c*, and 34*d*) of the levers 31 of the triggers 30, rotate the levers 31 of the triggers 30 in the clockwise direction, against the pressure from the above-mentioned springs (unshown). As the lever 31 in the state shown in FIG. 8(*a*) is rotated in the clockwise direction, it comes into contact with the aforementioned pin 72 of the shutter 70, as shown in FIG. 8(*b*), and causes the shutter 70 to rotate in the clockwise direction, or the opening direction, about the shutter supporting portions 71 and 71, against the pressure from the springs (unshown).

Next, referring to FIGS. 8(*a*) and 8(*b*), the above-described relationship between the shutter 70 and trigger 30 will be described in more detail.

FIG. 8(*a*) shows the hinged door 101, which is open, with the front end potion 33 of the lever 31 pointing upward. When the hinged door 101 is in this condition, the shutter 70 is in the position in which it covers the portion 1A of the photosensitive drum 1.

As the hinged door 101 is closed, the front end portion 33 of the lever 31 is moved downward, while pressing downward therefore the pin 72 attached to one of the lengthwise ends of the shutter 70. As a result, the shutter 70 is retracted away from the photosensitive drum 1 into the position shown in FIG. 8(*b*). It should be noted here that if the rotational axis of the lever 31 coincides with the rotational axis of the shutter 70, the shutter 70 can be more smoothly opened or closed than otherwise.

As the hinged door 101 is opened, the trigger 30 is moved by the movement of the hinged door 101, opening or closing the shutter 70, through the shutter mechanism 120 structured as described above.

Thus, the opening or closing of the shutters 70 of the plurality of cartridges 7 mounted in the apparatus main assembly 100 is regulated by the amount of movement of the levers 31 of the corresponding triggers 30.

The amount of the movement of the lever 30 is regulated by the shutter mechanism 120. Therefore, all the image forming stations (Pa, Pb, Pc, and Pd) are the same in the opening or closing movement of the shutters 70 of the cartridges 7 mounted in the cartridge compartment (8*a*, 8*b*, 8*c*, and 8*d*) of the image forming stations.

In recent years, demand by users for a smaller image forming apparatus has become stronger, making it necessary to squeeze a plurality of image forming stations different in development color into a limited amount of space. Thus, in order to further reduce in size an image forming apparatus, it is necessary to match the rotational angle (retraction angle) of the shutter 70 to each image forming station.

The structural arrangement, in this embodiment, for opening or closing the shutter 70, makes it possible to optionally set the rotational angle (retraction angle) of the shutter 70, for each station. Next, this structural arrangement will be described.

Figure 10:
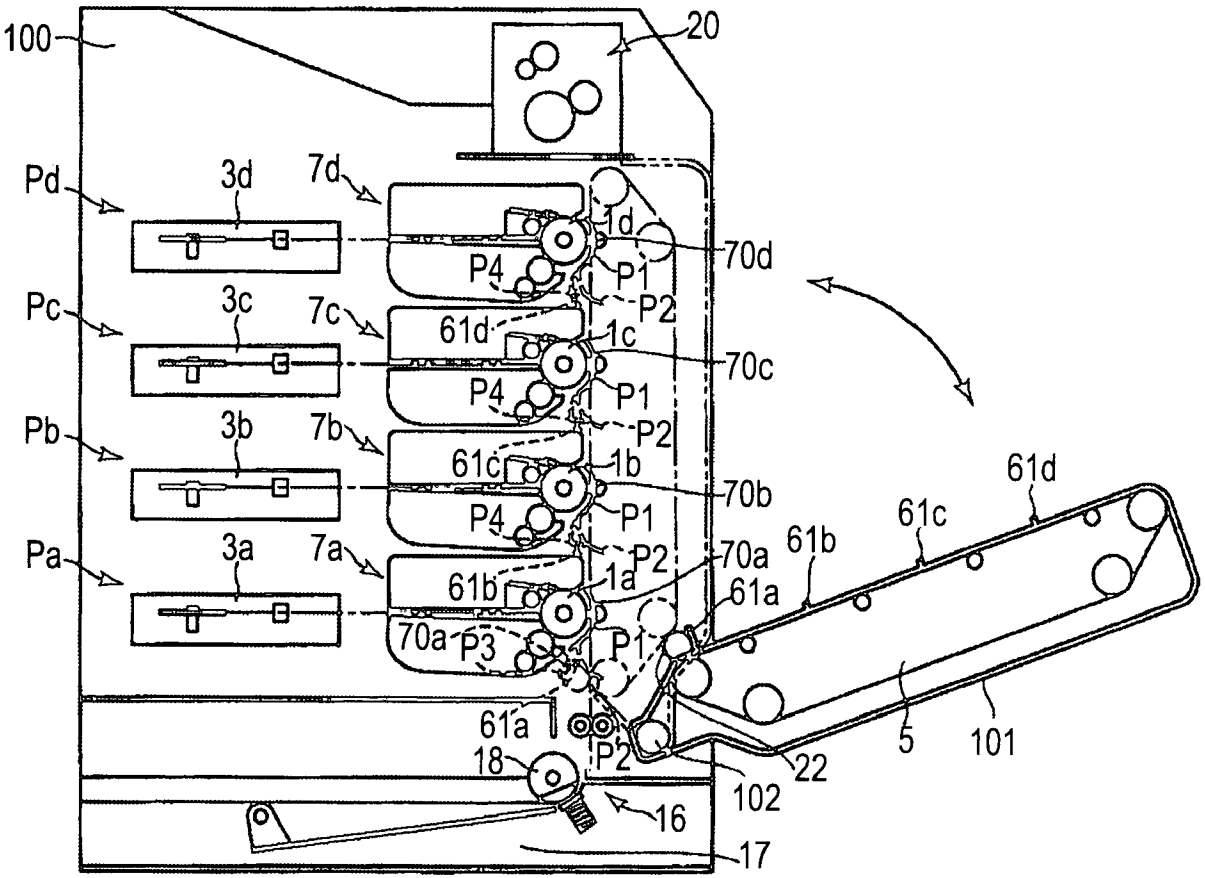
FIG. 10 is a schematic sectional view of the image forming apparatus in the first embodiment of the present invention, showing the general structure thereof.

Shown in FIG. 10 is the electrophotographic color image forming apparatus, in this embodiment, which employs a plurality of cartridges equipped with the shutter 70 (70*a*, 70*b*, 70*c*, and 70*d*).

The electrophotographic image forming apparatus in FIG. 10 is the same in structure and operation as the electrophotographic image forming apparatus described with reference to FIG. 1. In other words, the cartridges 7 in FIG. 10 are equipped with shutters which are the same as those in FIG. 1.

In the case of the image forming apparatus in this embodiment, the rotational angle of the shutter 70*a* of the cartridge 7 mounted in the image forming station Pa is different from those (positions into which they retract from photosensitive drums) of the shutters 70*b*, 70*c*, and 70*d* of the cartridges 7 mounted in the image forming stations Pb, Pc, and Pd, respectively.

More specifically, referring to FIG. 10, all the image forming stations are identical in the position in which the shutter 70 of the cartridge 7 in the image forming station covers the photosensitive drum 1; in other words, all the shutters 70 in the image forming stations P cover the photosensitive drums 1, in the position P1. However, they are different in the position into which they retract from the positions P1 in which they cover the photosensitive drum 1. That is, in the case of the cartridge 7 mounted in the station Pa, or the bottommost station, the shutter 70 is retracted into the position P3, whereas the shutters 70 of the cartridges 7 in the other stations Pb, Pc, and Pd are retracted into the positions P4. In other words, the structural arrangement is made so that the position, into which the shutter 70 of the cartridge 7*a* mounted in the bottommost image forming station Pa is retracted, becomes different from those into which the cartridges 7*b*, 7*c*, and 7*d* in the other stations Pb, Pc, and Pd; in other words, the angle by which the shutter 70*a* of the cartridge 7*a* mounted in the bottommost image forming station Pa is rotated is made greater than the angles by which the shutters 70*b*, 70*c*, and 70*d* of the cartridges 7*b*, 7*c*, and 7*d* mounted in the other stations Pb, Pc, and Pd are retracted.

The shutters 70 of the cartridges 7 in the stations Pb, Pc, and Pd, that is, the stations other than the bottommost station Pa, can be retracted from the positions in which they cover the photosensitive drum 1, into the positions P4 in which the shutters 70 do not interfere with the process cartridges in the stations immediately below.

In terms of the position into which the shutter 70 retracts, the station Pa is different from the stations Pb, Pc, and Pd in that it does not need to be regulated; the shutter 70 of the cartridge 7 in the station Pa can be retracted into the position P3.

With the shutter 70 of the cartridge 7 in the bottommost station Pa retracted to the position P3, the recording medium adhesion roller 22 which is in contact with the unit 5 can be prevented from interfering with the shutter 70*a* of the cartridge 7*a* in the bottommost station Pa when the hinged door 101 and unit 5 are rotated in the counterclockwise direction about the shaft 102 as shown in FIG. 10.

Figure 11:
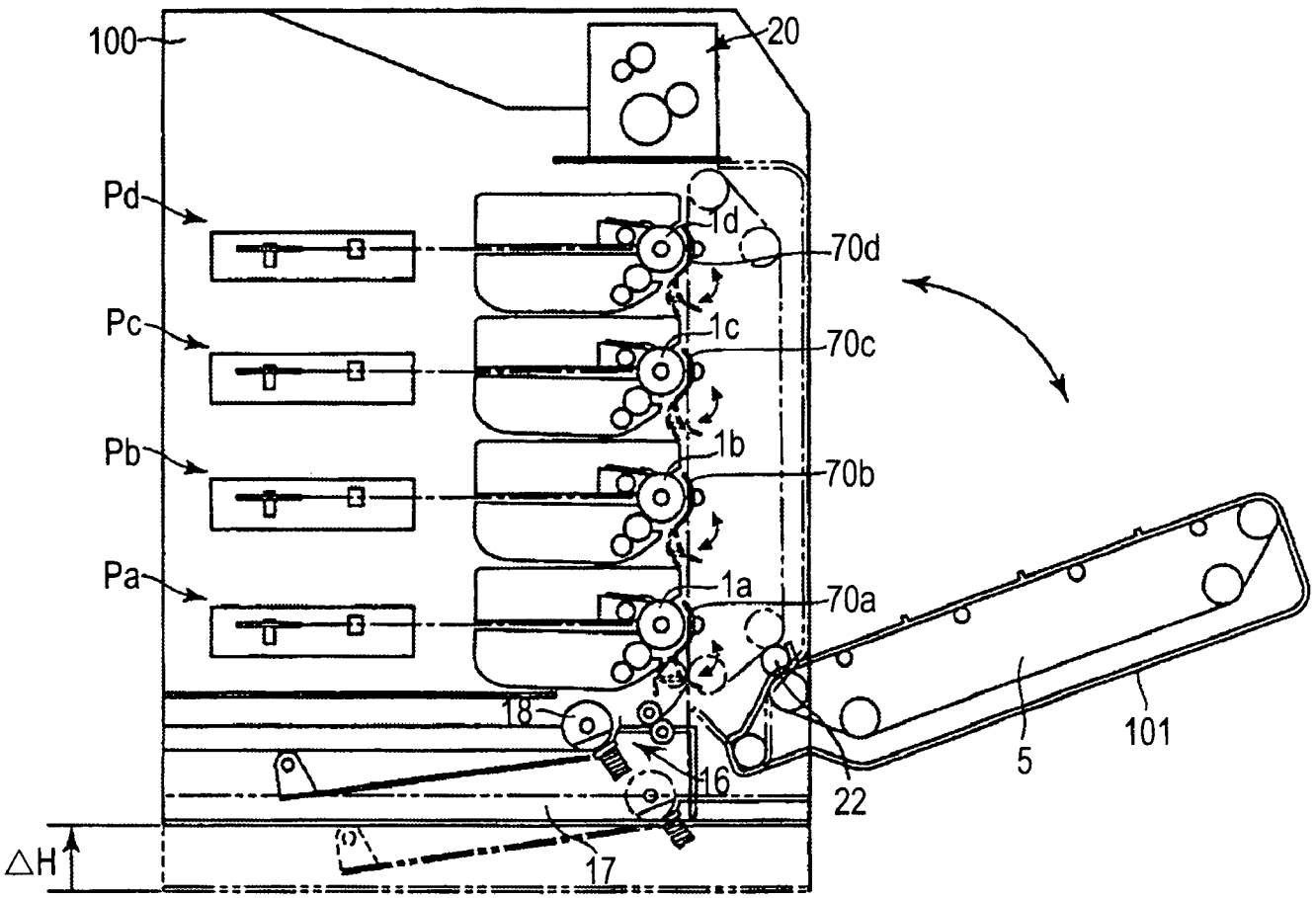
FIG. 11 is a schematic sectional view of the image forming apparatus in the first embodiment of the present invention, showing the general structure thereof.

In the case of the structural arrangement in accordance with the prior art, it was necessary to lower the roller 22 as shown by the hypothetical line in FIG. 11, in order to prevent the roller 22 from interfering with the shutter 70*a* of the cartridge 7*a* in the bottommost station Pa. Therefore, the recording medium feeding station 17 must also be lowered. This was one the essential causes for the increase in size of the main assembly 100 of an image forming apparatus.

When the apparatus main assembly 100 is structured, as in this embodiment, so that the position into which the shutter 70 is to be retracted can be optionally set, it is possible to create a space between the recording medium feeding station 17 which is in the bottom portion of the apparatus main assembly 100, and the cartridge 7*a*, or the cartridge in the bottommost station Pa. This space can be reduced by ΔH to reduce the size of the apparatus main assembly 100 by ΔH as shown in FIG. 11.

In this embodiment, the rotational angle (retraction angle) of the shutter 70 of the cartridge 7 in each station can be made different from those of the shutters 70 of the cartridges 7 in the other stations, while employing only a single shutter mechanism 120 for all the stations P.

Referring to FIG. 10, when the hinged door 101 is open, the shutter 70 of the cartridge 7 in each station P is in the position P1, or the first position, covering the photosensitive drum 1. As the hinged door 101 in this station is closed, the front end portion 33 of the lever 31 of the trigger 30 is lowered, opening therefore the shutter 70 in each station P, as described before with reference to FIG. 7.

During this closing movement of the hinged door 101, the shutters 70 of the cartridges 7 in all the stations P are moved from positions P1 to positions P2 shown in FIG. 10, by the shutter mechanism 120 shown in FIG. 9.

Since a single shutter mechanism 120 is used to move all the shutters 70, all stations P are the same in rotational angle (retraction angle) of the shutter 70.

Figure 12:
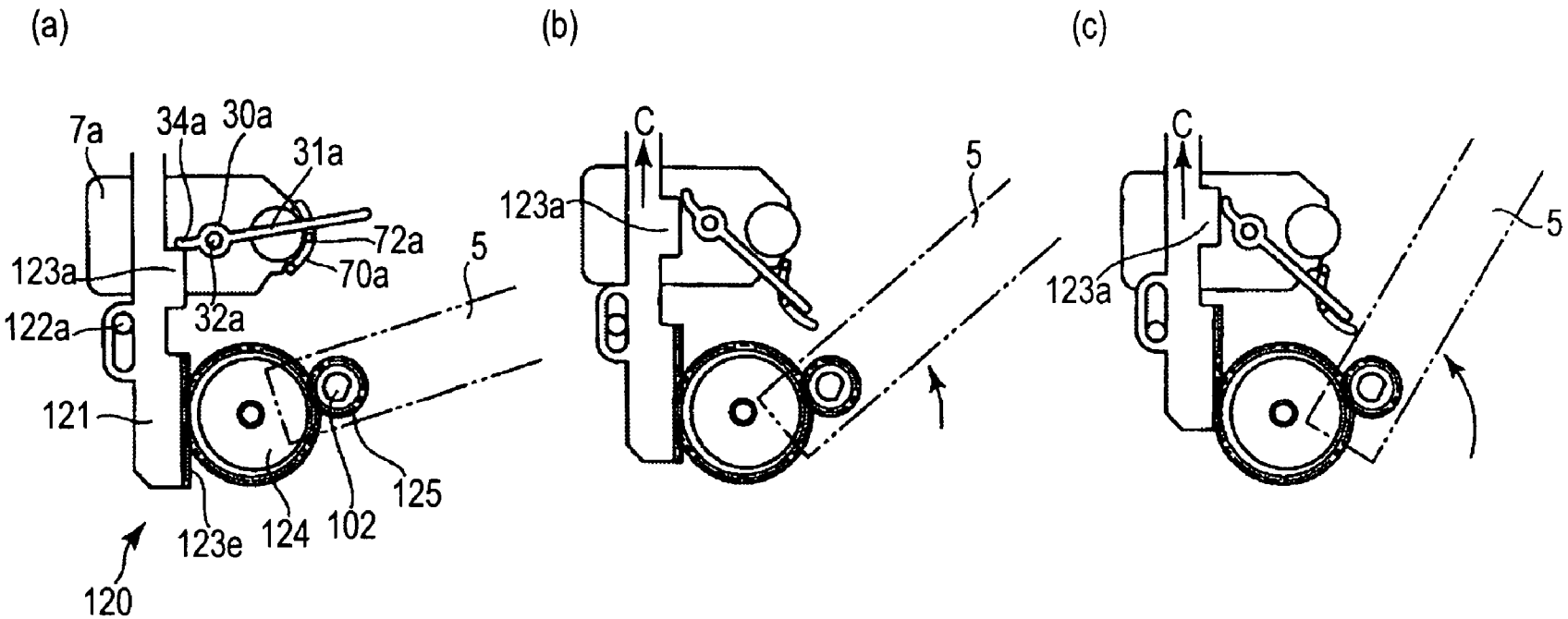
FIGS. 12(*a*)–12(*c*) are perspective views for showing the movements of the shutter trigger, and mechanism, for opening or closing the drum shutter of the process cartridge.

The shutter mechanism 120 in this embodiment is structured so that once the hinged door 101 is closed into the position shown in FIG. 7, the further rotation of the hinged door 101 in the closing direction does not rotate the triggers 30 downward. For example, it is structured as shown in FIG. 12. Next, the structure of the shutter mechanism 120 in this embodiment will be described with reference to the station Pa, or the bottommost station.

As the unit 5 is rotated in the closing direction, or the counterclockwise direction, from the position shown in FIG. 12(*a*), the gear 125 is rotated also in the counterclockwise direction, while rotating the idler gear 124, which is meshed with the gear 125, in the clockwise direction. As a result, the trigger moving member 121 having the rack portion 123*e* meshed with the idler gear 124 is moved in the direction indicated by the arrow mark C (FIG. 12(*b*)).

During this movement of the trigger moving member 121, its projection 123*a* which is in contact with the rear end portion 33*a* of the lever 31*a* of the trigger 30*a*, rotates the lever 31*a* in the clockwise direction against the resiliency of the springs (unshown).

The lever 31*a* of the trigger 30*a* is rotated in the clockwise direction from the position shown in FIG. 12(*a*), while remaining in contact with the shutter pin 72*a* of the shutter 70*a*, as shown in FIG. 12(*b*), and therefore, rotating the shutter 70*a* in the clockwise direction against the resiliency of the springs (unshown).

First, the trigger 30*a* is rotated in the clockwise direction by the movement of the trigger moving member 121 in the direction of the arrow mark C as shown in FIGS. 12(*a*) and 12(*b*). Then, the rear end portion 34*a* of the trigger 30*a* moves onto the projection 123*a* on the frontward surface of the trigger moving member 121 (FIG. 12(*c*)) as shown in FIGS. 12(*b*) and 12(*c*). As a result, the trigger 30*a* stops rotating in spite of the further movement of the trigger moving member 121 in the direction of the arrow mark C.

According to this embodiment, the rotational angle (retraction angle) of the shutter 70 is made variable. Thus, in order to make the rotational angle (retraction angle) variable, the hinged door 101 is provided with shutter retraction regulating member (61*a*, 61*b*, 61*c*, and 61*d*) as members for pressing the shutters 70 (hereinafter, these members 61*a*–61*d* will be referred to as regulating members). The regulating member is enabled to make each station P different in the rotational angle of the shutter 70 from the other stations P.

The regulating member is positioned so that it presses on one or both of the lengthwise ends of the shutter 70. In other words, it is on one or both sides of the path through which the recording medium S conveyed by the conveyer belt 11. More specifically, it is one or both lateral walls of the hinged door 101 that are provided with the regulating members. The regulating members may be formed as integral parts of the frame of the unit 5, instead of the hinged door 101.

Referring to FIG. 10, in this embodiment, the hinged door 101 is provided with four regulating members 61*a*–61*d* regulating member 61*a* as a first regulating member and regulating members 61*b*, 61*c*, and 61*d* as second regulating members. The first regulating member 61*a* is a rectangular projection shaped so that it projects toward the shutter 70*a* of the cartridge 7*a* mounted in the cartridge compartment 8*a* of the station Pa, or the bottommost station of the apparatus main assembly 100, whereas the second regulating members 61*b*, 61*c*, and 61*d* are rectangular projections shaped so that they project toward the cartridges 7*b*, 7*c*, and 7*d* mounted in the cartridge compartments 8*b*, 8*c*, and 8*d* of the other stations, or the stations Pb, Pc, and Pd, respectively.

The first regulating member 61*a* is different from the second regulating members 61*b*, 61*c*, and 6*d*, in the amount by which it projects toward the drum shutter 70. Therefore, it is different from them, in the angle by which it rotates (retracts) the drum shutter 70.

In other words, the hinged door 101 in the wide open state as shown in FIG. 10 is moved to the position shown in FIG. 7, and then, is closed all the way from this position to the completely closed position. As the hinged door 101 is moved as described above, the shutter 70 of the cartridge 7 in each station P is pressed by the regulating member 61, being further retracted from the position P2. The stations P can be made different in the distance by which the regulating member 61 projects toward the corresponding shutter 70, as described above.

In this embodiment, the distance the first regulating member 61*a* projects toward the shutter 70 is greater than those by which the second regulating members 61*b*, 61*c*, and 61*d* do. The distances the second regulating members 61*b*, 61*c*, and 61*d* project toward the shutter 70 are roughly the same.

In other words, the rotational angle (retraction angle) of the shutter 70 in the bottommost station P is greater than those of the shutters 70 of the cartridges 7 in the other stations P.

Referring to FIG. 10, the first regulating member 61*a* presses the shutter 70*a* of the cartridge 70*a* in the bottommost station Pa, causing the shutter 70*a* to move from the position P2 to the position P3. In comparison, the shutters 70*b*, 70*c*, and 70*d* of the cartridges 7*b*, 7*c*, and 7*d* in the stations Pb, Pc, and Pd are pressed by the second regulating members 61*b*, 61*c*, and 61*d*, being thereby moved from the positions P2 to the positions P4, respectively.

As above-described, the shutters 70 are pressed by the first regulating member 61*a*, and second regulating members 61*b*, 61*c*, and 61*d*. With these actions of the regulating members 61, the shutters 70 are precisely positioned to secure the passage for the recording medium S.

The above-described structural arrangement makes it possible to optionally set the rotational angle (retraction angle) of the shutter 70 of the cartridge 7 in each station P, without the need for differentiating the shutter mechanism of each station from those of the other stations. Therefore, not only is it possible to reduce in size an image forming apparatus, but also, it is possible to integrate the regulating members 61 with the hinged door 101, making it therefore possible to realize a cost reduction.

Incidentally, in the above, this embodiment was described assuming that the hinged door 101 is opened or closed along with the unit 5 for conveying the recording medium S and transferring the toner images from the photosensitive drums 1 onto the recording medium S. However, this embodiment is also compatible with, that is, applicable to, an image forming apparatus employing an intermediary transferring member, onto which the toner images are temporarily transferred from the photosensitive drums 1, and from which the transferred images are transferred onto the recording medium S. The effects of such an application are the same as those described above. In other words, all that is necessary is for the hinged door 101 to be integral with the intermediary transfer unit comprising the intermediary transferring member and the box (shell) therefore and for the first and second regulating members to be integral with the intermediary transfer unit.

Embodiment 2

Figure 13:
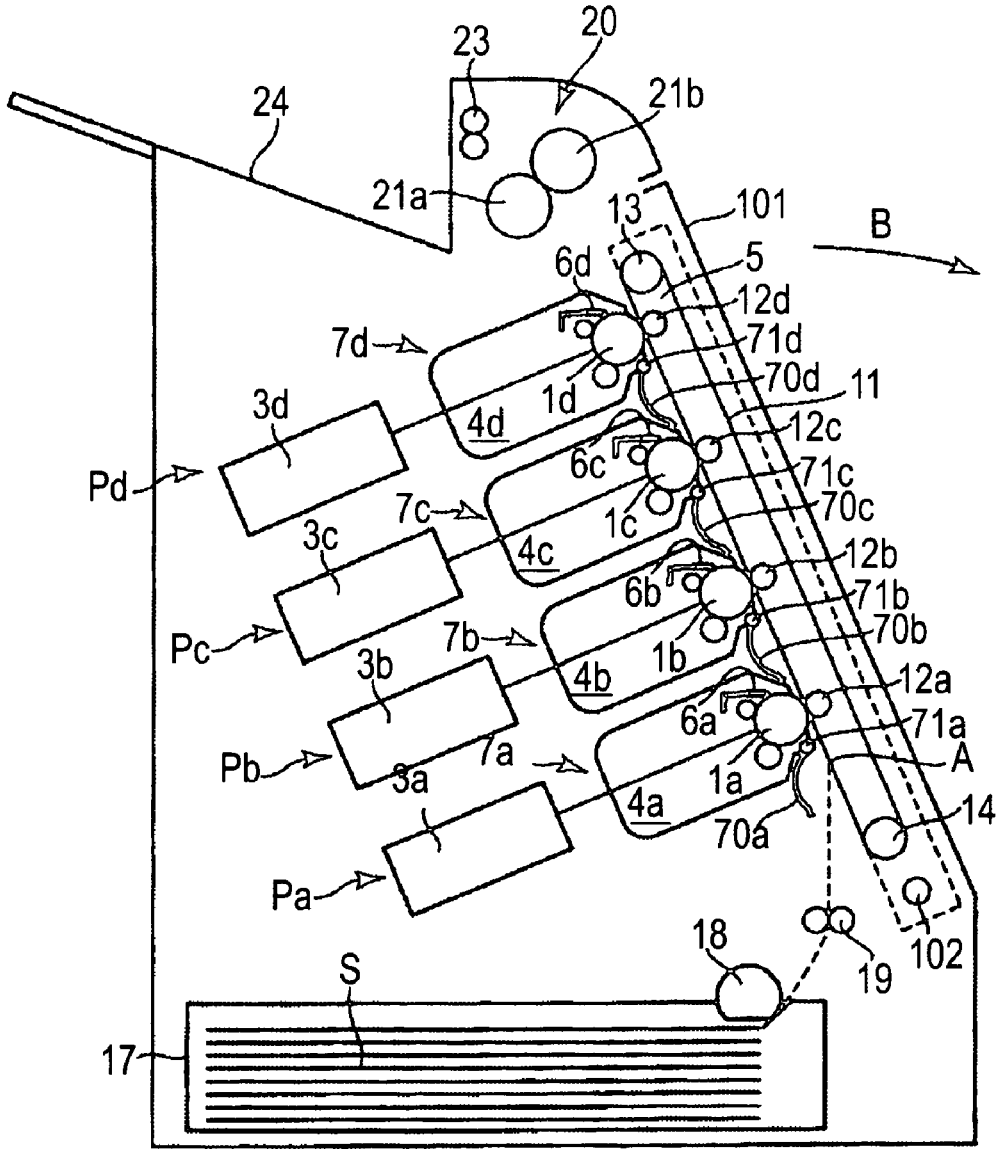
FIG. 13 is a schematic sectional view of the image forming apparatus in another embodiment of the present invention, showing the general structure thereof.

FIG. 13 is a schematic sectional view of the electrophotographic image forming apparatus in another embodiment of the present invention. The electrophotographic image forming apparatus in this embodiment is the same in structure as the electrophotographic color image forming apparatus in the first embodiment, except that the stations Pa, Pb, Pc, and Pd in this embodiment are stacked in parallel in the direction slightly angled from the true vertical direction. Thus, the components, members, portions, etc., the image forming apparatus in this embodiment identical to those of the image forming apparatus in the first embodiment will be given the same referential symbols as those given for the description of the first embodiment so that the descriptions of the first embodiment can be borrowed for the description of the second embodiment.

Thus, essentially, the aspect of the electrophotographic image forming apparatus in this embodiment, which characterises the apparatus, will be described.

Also in the case of the image forming apparatus in this embodiment, a toner image is formed on the photosensitive drum 1 in each station, following the same image formation sequence as that followed by the apparatus in the first embodiment.

In other words, the recording media S are sent out one by one from the cassette 17. Each recording medium S is rectified in attitude, if it was sent out askew, as its leading edge comes into contact with the pair of registration rollers 19. Then, it is released with a predetermined timing, to be sent to the conveyer belt 11.

After being released and sent to the conveyer belt 11 by the registration rollers 19, the recording medium S is adhered to the conveyer belt 11 at the adhesion point A, and is further conveyed by the conveyer belt 11. The adhesion point A is the intersection of the straight line tangential to the peripheral surfaces of both registration rollers 19, and the surface of the conveyance belt 11.

As predetermined biases are applied to the transfer rollers (12*a*, 12*b*, 12*c*, and 12*d*) positioned so that their peripheral surfaces oppose the peripheral surfaces of the photosensitive drums 1 (1*a*, 1*b*, 1*c*, and 1*d*), respectively, the toner images, different in color, on the photosensitive drums 1 (1*a*, 1*b*, 1*c*, and 1*d*) are transferred onto the recording medium S while the recording medium S adhered to the conveyed belt 11 is conveyed.

After the transfer of the toner images different in color onto the recording medium S, the recording medium S is conveyed to a pair of fixation rollers 21*a* and 21*b*, and while it is conveyed through the nip between the fixation rollers 21*a* and 21*b*, the toner images are welded to the recording medium S by the heat and pressure applied by the fixation rollers 21*a* and 21*b*, turning into a permanent color image. After being moved between the fixation rollers 21*a* and 21*b*, the recording medium S is discharged by a pair of discharge rollers 23, into the delivery tray 24, being layered therein.

Also in this embodiment, the cartridges 7 (7*a*, 7*b*, 7*c*, and 7*d*) are provided with shutters 70 (70*a*, 70*b*, 70*c*, and 70*d*) for protecting the portions 1A of the photosensitive drums 1 (1*a*, 1*b*, 1*c*, and 1*d*).

Figure 14:
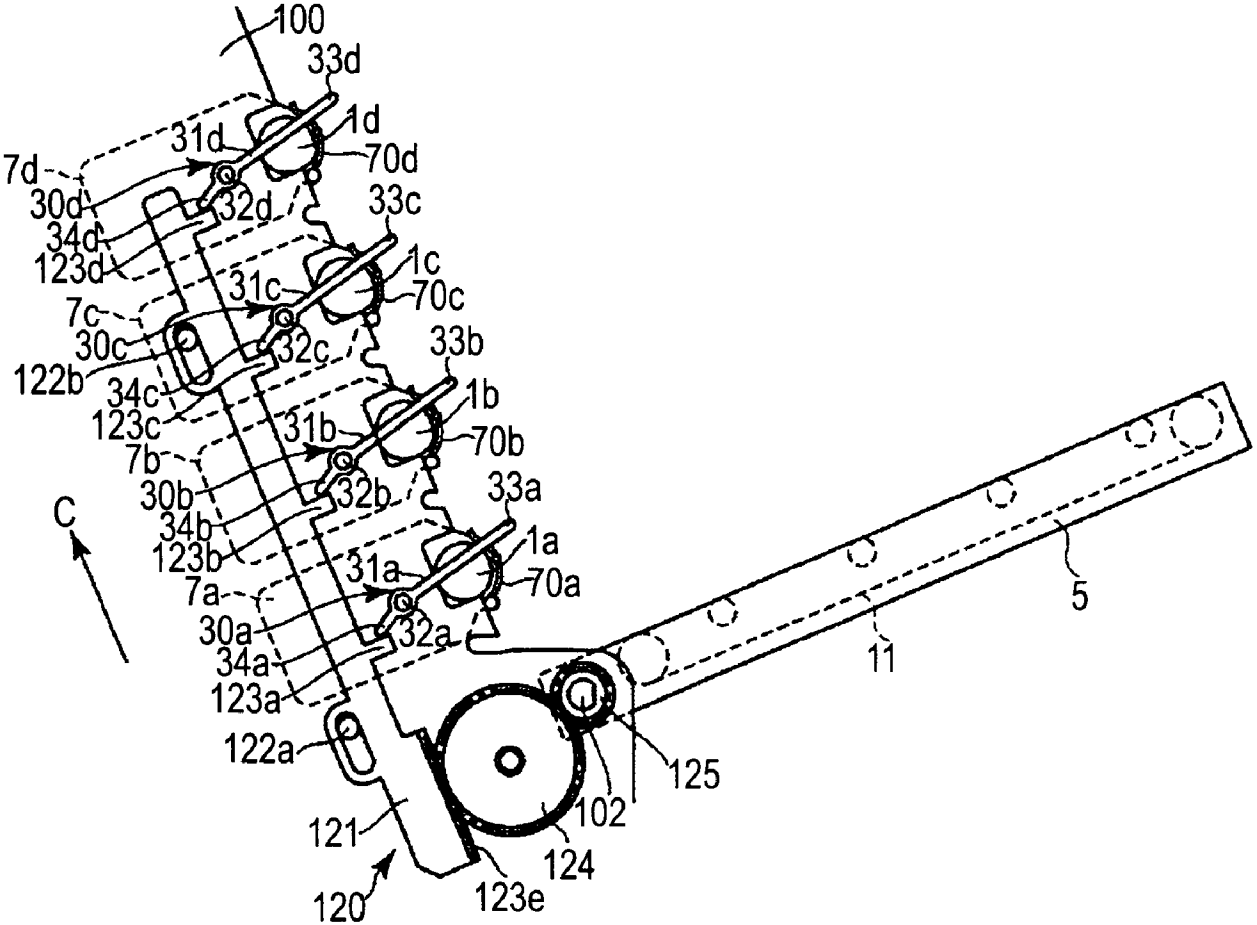
FIG. 14 is a perspective drawing for showing the movements of the shutter trigger, and mechanism, for opening or closing the drum shutter of the process cartridge.

Referring to FIG. 14, when the cartridge mounting opening is completely exposed, that is, after the unit 5 has been rotated, along with the hinged door 101, all the way from the apparatus main assembly 100, the shutters 70 are closed, covering the photosensitive drums 1 to protect them. However, as the unit 5 is rotated back onto the apparatus main assembly 100 as shown in FIG. 11, the shutters 70 are opened to prevent them from coming into contact with the conveyer belt 11 and also, to allow the toner images on the photosensitive drums 1 to be transferred onto the recording medium S; in other words, the shutters 70 are retracted into the positions in which they expose the portions 1A of the photosensitive drums 1. This structural arrangement is the same as that in the first embodiment.

At this time, the angle by which the shutters 70 are opened will be described.

Referring to FIG. 4, after the cartridges 7 have been mounted into the apparatus main assembly 100, and the hinged door 101 has been completely closed, the shutter 70 of each cartridge 7 is kept in the position (at an angle) in which its edge does not interfere with the cartridge 7 in the other stations, that is, there remains slightly away from the conveyer belt 11, as shown in FIG. 13.

The opening and closing movements of the above-described shutters 70 (70*a*, 70*b*, 70*c*, and 70*d*) are the same as those in the first embodiment. That is, they are opened or closed by the shutter mechanism 120 as a shutter opening means, which is moved by the rotation of the combination of the hinged door 101 and unit 5 about the shaft 102.

Figure 15:
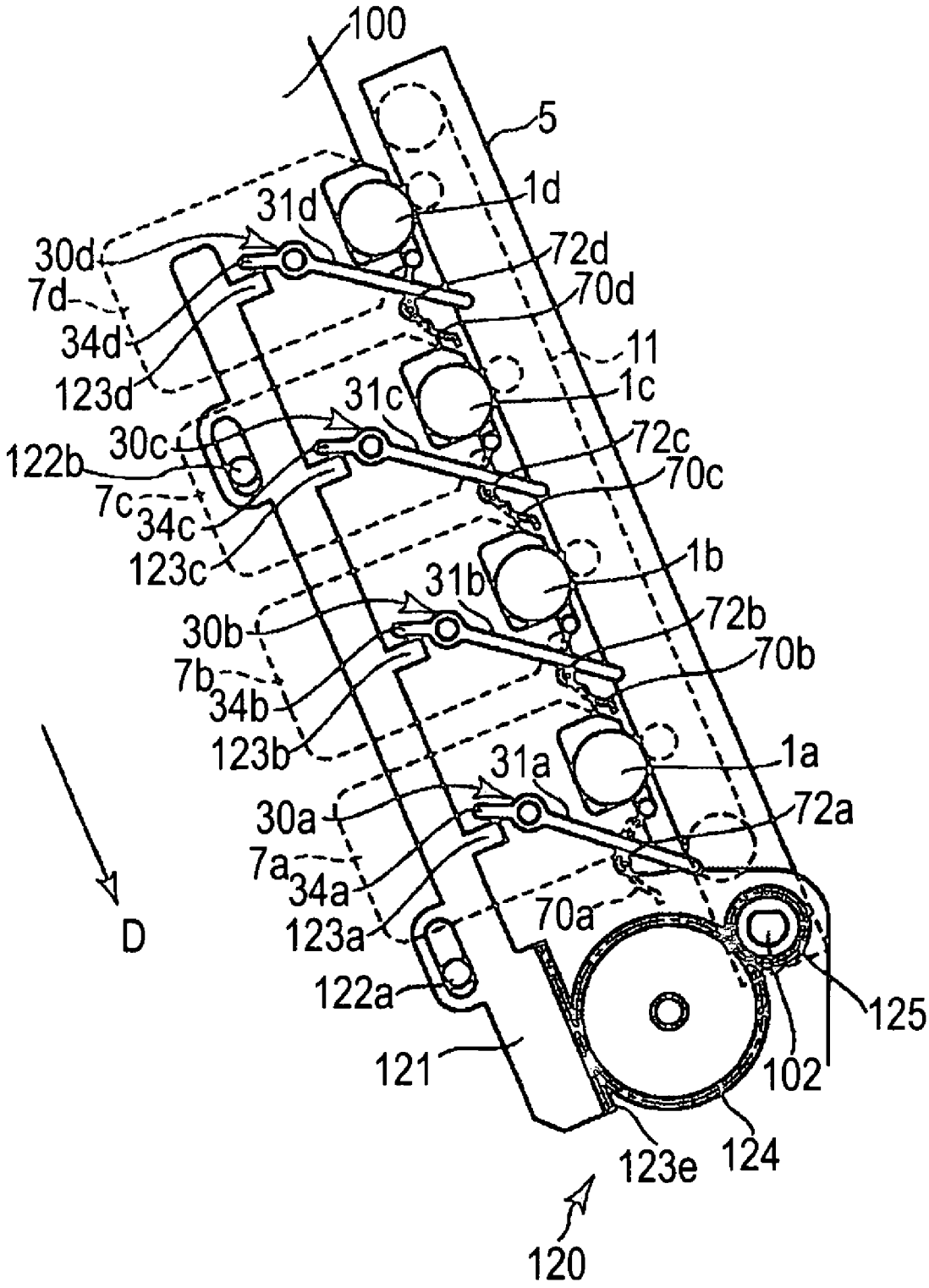
FIG. 15 is a perspective drawing for showing the movements of the shutter trigger, and mechanism, for opening or closing the drum shutter of the process cartridge.

However, this embodiment is different from the first embodiment in that the shutter 70*a* of the cartridge 7*a* is opened by a greater angle, and is retained at this angle, as shown in FIG. 15, in order to prevent its edge from interfering with the recording medium S sent from the registration rollers 19.

Next, referring to FIGS. 14 and 15, the shutter mechanism 120 which characterises this embodiment will be described. FIGS. 14 and 15 do not show the hinged door 101; they have been simplified to make the drawings easier to understand.

FIG. 14 shows the unit 5 which is open, and the shutters 70 which are closed, whereas FIG. 15 shows the unit 5 which is closed (has been rotated back onto apparatus main assembly), and the shutters 70 which are open.

The shutter mechanism 120 employed in this embodiment is the same as the shutter mechanism 120 in the first embodiment described with reference to FIG. 9. Thus, the components, members, portions, etc., in this embodiment, which are the same in structure and function as those in the first embodiment, are given the same reference symbols as those given in the first embodiment.

In other words, also in this embodiment, the shutter mechanism 120 is provided with the trigger moving member 121, which is supported by the shafts 122*a* and 122*b* so that it can be moved upward or downward. More specifically, the trigger moving member 121 in this embodiment is slightly tilted relative to the true vertical direction, at the same angle as the angle of the direction, in which the stations P (Pa, Pb, Pc, and Pd) are stacked in parallel, relative to the true vertical direction.

The trigger moving member 121 is provided with a plurality of projections (123*a*, 123*b*, 123*c*, and 123*d*), and a rack portion 123*e*. The projections project from the frontward surface of the member 121. The rack portion 123*e* is a part of the bottom end of the member 121, being therefore located below the projection 123*a*, or the bottommost projection.

This embodiment is different from the first embodiment in that the projection 123*a*, which corresponds to the bottommost trigger 30*a*, is longer than the other projections 123*b*, 123*c*, and 123*d*. This characteristic will be described later in more detail.

The lever 31 of the trigger 30 is kept pressured by a pressure applying means (unshown) in the direction to rotate the trigger 30 in the counterclockwise direction of FIG. 14 about the shaft 32. The rear end portion 34 (34*a*, 34*b*, 34*c*, and 34*d*) of the lever 31 of each trigger 30 is in contact with the top surface of the corresponding projection (123*a*, 123*b*, 123*c*, and 123*d*).

The rack portion 123*e*, or the bottommost portion, of the trigger moving member 121, is meshed with an idler gear 124, which is meshed with a gear 125 attached to the shaft 102 which rotationally supports the hinged door 101. The shaft 102, which rotationally supports the gear 125, extends outward from the unit 5 through the side plates of the apparatus main assembly 100.

As the hinged door 101, to which the unit 5 is held, is closed, the unit 5 in the state shown in FIG. 14 is rotated in the counterclockwise direction, causing the gear 125 to be rotated in the counterclockwise direction. As a result, the idler gear 124 meshed with the gear 125 is rotated in the clockwise direction, moving the trigger moving member 121 having the rack portion 123*e* meshed with the gear 124, in the direction indicated by an arrow mark C.

As the trigger moving member 121 is moved in the abovementioned direction, its projections (123*a*, 123*b*, 123*c*, and 123*d*), which are in contact with the rear end portions 34 (34*a*, 34*b*, 34*c*, and 34*d*) of the levers 31 of the triggers 30, rotate the levers 31 of the triggers 30 in the clockwise direction, against the pressure from the above-mentioned springs (unshown).

As the lever 31 of the trigger 30 in the state shown in FIG. 14 is rotated in the clockwise direction, it comes into contact with the aforementioned shutter pin (72*a*, 72*b*, 72*c*, and 72*d*) of the shutter 70, as shown in FIG. 15, and causes the shutter 70 (70*a*, 70*b*, 70*c*, and 70*d*) to rotate in the clockwise direction, or the opening direction, against the resiliency from the springs (unshown).

Referring to FIG. 15, as the unit 5 is closed, the trigger 30 presses on the shutter pin of the shutter 70, rotating thereby the shutter 70 until a predetermined positional relationship is realized between the shutter 70 and unit 5.

In this embodiment, the projection 123*a* is longer than the other projections 123*b*, 123*c*, and 123*d*. Therefore, the angle by which the lever 31*a* of the trigger 30*a* is rotated by the projection 123*a* is greater than the angles by which the levers of the other triggers 30 are rotated. Therefore, the shutter 70*a* of the cartridge 70*a* is opened wider than the other shutters 70. In other words, in the case of the second embodiment, the function of the pressing member in the above-described first embodiment is carried out by the shutter opening means.

On the other hand, as the unit 5 in the state shown in FIG. 15 is rotated in the clockwise direction, that is, as the unit 5 is opened, the trigger moving member 121 is moved in the direction indicated by an arrow mark D by the rotational force transmitted thereto through the gears 125 and idler gear 124. Therefore, the triggers 30 are rotated in the counterclockwise direction, while remaining in contact with the projections (123*a*, 123*b*, 123*c* and 123*d*), about the shafts 32 (32*a*, 32*b*, 32*c*, and 32*d*), by the resiliency of the springs (unshown). As a result, the pins (72*a*, 72*b*, 72*c*, and 72*d*) of the shutters 70 (70*a*, 70*b*, 70*c*, and 70*d*) are pressed by the front end portions 33 (33*a*, 33*b*, 33*c*, and 33*d*) of the triggers 30. Consequently, the shutters 70 are rotated in the counterclockwise direction about the shutter supporting portions 71; the shutters are closed by the resiliency of the springs (unshown).

As above-described, in this embodiment, the most upstream shutter 70*a*, in terms of the recording medium conveyance direction, is opened wider by the shutter mechanism 120 than the rest. Therefore, the end of the drum shutter 70*a* does not interfere with the recording medium S. In other words, the employment of the structural arrangement in this embodiment makes it possible to locate the recording medium adhesion point A on the downstream side of the tip of the drum shutter 70*a*, without widening the interval between the adjacent two process cartridges. Therefore, it makes it possible to reduce the length of the conveyer belt 11, making it therefore possible to reduce the apparatus main assembly in size, as well as cost.

Embodiment 3

Next, the electrophotographic image forming apparatus in another embodiment of the present invention will be described.

The electrophotographic image forming apparatus in this embodiment is the same as the electrophotographic color image forming apparatus in the above described second embodiment. Thus, the components, members, portions, etc., of the image forming apparatus in this embodiment identical in structure and function to those of the image forming apparatus in the second embodiment will be given the same reference symbols as those given for the description of the second embodiment, and will not be described regarding its structure, operation, etc.

Figure 16:
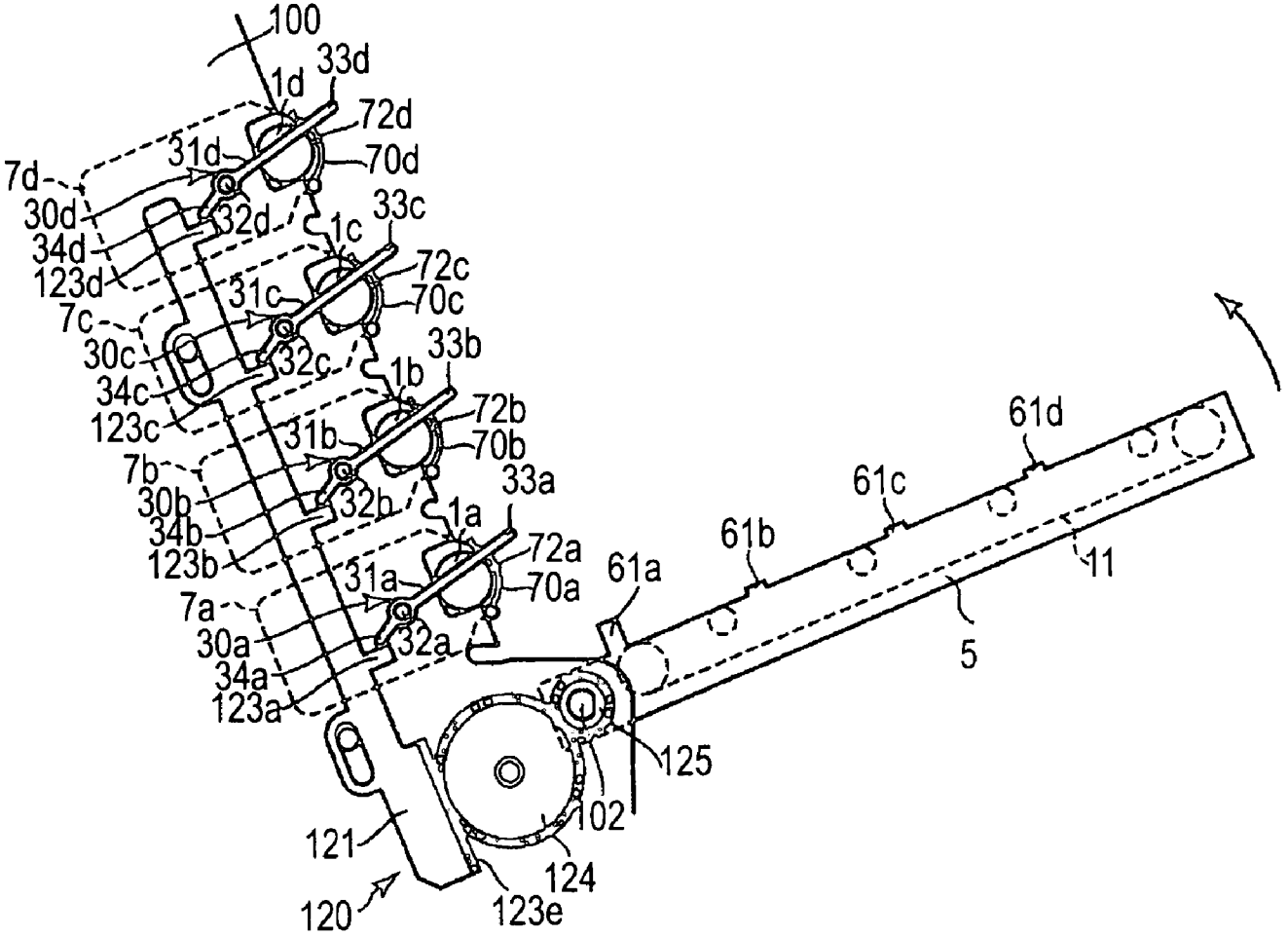
FIG. 16 is a perspective drawing for showing the movements of the shutter trigger, and mechanism, for opening or closing the drum shutter of the process cartridge.
Figure 17:
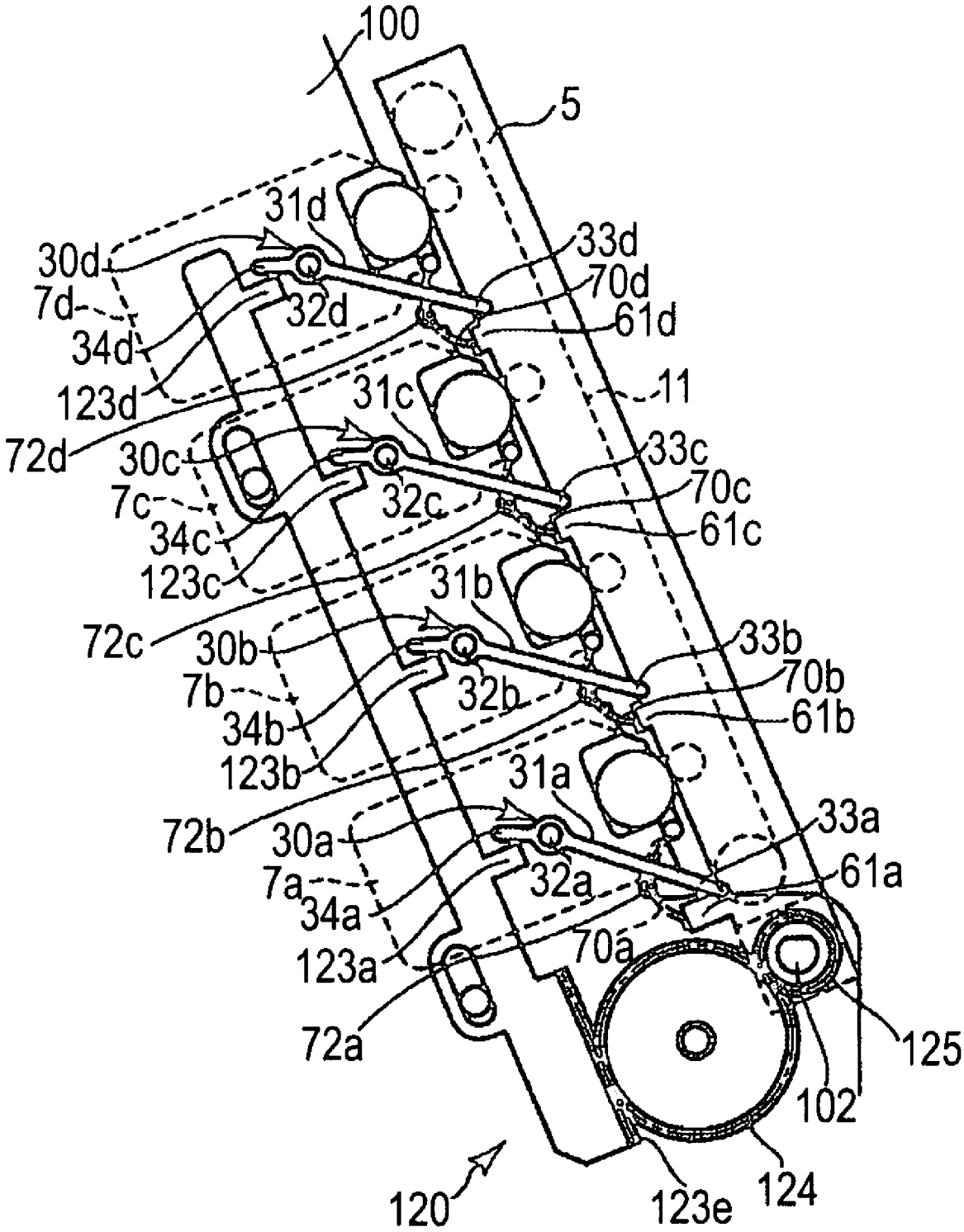
FIG. 17 is a perspective drawing for showing the movements of the shutter trigger, and mechanism, for opening or closing the drum shutter of the process cartridge.

Hereinafter, referring to FIGS. 16 and 17, essentially, the aspect of the shutter mechanism 120 of the electrophotographic image forming apparatus in this embodiment, which characterises this embodiment, will be described. FIG. 16 shows the unit 5 which is open, and the shutters 70 (70*a*, 70*b*, 70*c*, and 70*d*) which are closed, whereas FIG. 17 shows the unit 5 which is closed (has been rotated back onto apparatus main assembly), and the shutters 70 (70*a*, 70*b*, 70*c*, and 70*d*) which are open.

In this embodiment, the projections (61*a*, 61*b*, 61*c*, and 61*d*) as pressing members are attached to the frame of the unit 5. Obviously, they may be attached to the hinged door 101.

As the unit 5 in the state shown in FIG. 16 is rotated in the counterclockwise direction (closing direction), the levers 31 of the triggers 30 are rotated about the shaft 32 by the shutter mechanism 120, as they are in the second embodiment, and the front portions 33 of the levers 31 press downward the pins (72*a*, 72*b*, 72*c*, and 72*d*) of the shutters 70.

As a result, the shutters 70 (70*a*, 70*b*, 70*c*, and 70*d*) are opened. However, before the shutters 70 (70*a*, 70*b*, 70*c*, and 70*d*) are opened to predetermined positions, their leading edges, in terms of the opening direction, come into contact with the projections (61*a*, 61*b*, 61*c*, and 61*d*). Thereafter, the shutters 70 (70*a*, 70*b*, 70*c*, and 70*d*) are opened by the projections 61 (61*a*, 61*b*, 61*c*, and 61*d*) to the predetermined positions, and retained there, against the resiliency of the springs (unshown).

Since the projection 61*a* is longer than the other projections 61*b*, 61*c*, and 61*d*, the shutter 70*a* of the cartridge 7*a* is opened wider than the shutters 70 of the other cartridges 7. Further, the rotational angle of the lever 31 is slightly smaller than that of the lever 31 in the second embodiment. After the shutters 70 (70*a*, 70*b*, 70*c*, and 70*d*) are opened by the predetermined angle (to predetermined positions), the shutter pins 72 are not in contact with the levers 31, as shown in FIG. 17.

Not only does this embodiment provide the same effects as those provided by the second embodiment, but also, the angles by which the shutters are opened are regulated by the projections, with which the frame of the unit 5 having the conveyer belt 11 is provided. Therefore, the distances between the shutters 70 and conveyer belt 11 can be set and maintained at a higher level of precision, making it possible to prevent the interference between the recording medium S and shutters 70 attributable to the tolerance in the measurements of the components, vibrations, etc., improving thereby the image forming apparatus in recording medium conveyance.

As described above, according to the present invention, not only can an electrophotographic image forming apparatus be reduced in size, but also, in the distance of the recording medium conveyance path.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 134624/2004 filed Apr. 28, 2004, which is hereby incorporated by reference.

What is claimed is:

1. An electrophotographic image forming apparatus for forming an image on a recording material, wherein a plurality of process cartridges are detachably mountable to said electrophotographic image forming apparatus along a substantially vertical line, the process cartridges each having an electrophotographic photosensitive drum, process means actable on the electrophotographic photosensitive drum, a drum shutter rotatably supported on a cartridge frame configured to move between a first position for covering an exposure portion so as not to expose the electrophotographic photosensitive drum through the cartridge frame and a second position, retracted from the first position, for uncovering the exposure portion to expose the electrophotographic photosensitive drum, said apparatus comprising:

mounting portions configured and positioned to detachably mount the process cartridges;

an opening for permitting passage of the process cartridges into said image forming apparatus;

a covering member configured and positioned to cover said opening and being movable between a close position for closing said opening and an open position, retracted from said close position, for opening said opening;

a pressing member configured and positioned to abut the drum shutter to move the drum shutter to the second position thereof when said covering member moves from the open position to the close position, wherein the angle of rotation of the drum shutter rotated by said pressing member from the first position to the second position in one of the process cartridges that takes a bottommost position among the process cartridges is larger than the angle of rotation of the drum shutter rotated by said pressing member from the first position to the second position in another one of the process cartridges.

2. An apparatus according to claim 1, wherein said pressing member is provided in said covering member.

3. An apparatus according to claim 2, further comprising shutter releasing means configured and positioned to move the drum shutters of the process cartridges from the first position to a third position, which is away from the first position by a predetermined angle in interrelation with movement of said covering member from the open position to the close position when the process cartridges are mounted on said mounting means, wherein said pressing member rotates said drum shutters from the third position to the second position.

4. An apparatus according to claim 2, wherein said pressing member includes a plurality of projections provided on an inside of said covering member, wherein said projections are disposed corresponding to the respective process cartridges, and the height of projection from said covering member for the bottommost process cartridge is larger than heights of projections of the other process cartridges.

5. An apparatus according to claim 4, wherein the heights of projections of the other process cartridges are substantially the same.

6. An apparatus according to claim 2, wherein said covering member includes a feeding belt configured and positioned to feed the recording material, wherein said pressing member is disposed at each of one and the other sides of said feeding belt, interposing said feeding belt with respective to a direction crossing a feeding direction of the recording material.

7. An apparatus according to claim 1, wherein when one of the process cartridge is set in a mounting position mounted on one of said mounting portions, the drum shutter of said one of the process cartridges is rotated substantially downwardly.

8. An apparatus according to claim 1, wherein the angles of rotation from the first positions to the respective second positions in said process cartridges other than the bottommost one are the same.

9. An apparatus according to claim 1, wherein the recording material is accommodated in a cassette which is disposed below the bottommost process cartridge, and is fed substantially upwardly by feeding means.

10. An apparatus according to claim 1, wherein the pressing member, when said process cartridges are mounted on said mounting portion, moves the drum shutter from the first position to the second position in interrelation with movement of said covering member from the open position to the close position.

* * * * *

UNITED STATES PATENT AND TRADEMARK OFFICE

CERTIFICATE OF CORRECTION

PATENT NO. : 7,155,141 B2
APPLICATION NO. : 10/960227
DATED : December 26, 2006
INVENTOR(S) : Masaaki Sato et al.

It is certified that error appears in the above-identified patent and that said Letters Patent is hereby corrected as shown below:

COLUMN 4:
Line 55, “is” should read --are--.

COLUMN 8:
Line 66, “cover” should read --covers--.
Line 67, “opening” should read --opening.--.

COLUMN 15:
Line 23, “acterises” should read --aceterizes--.

COLUMN 16:
Line 35, “characterises” should read --characterizes--.

COLUMN 18:
Line 35, “characterises” should read --characterizes--.

COLUMN 19:
Line 52, “opening;” should read --opening; and--.

COLUMN 20:
Line 35 claim 6, “respective” should read --respect--.
Line 38 claim 7, “cartridge” should read --cartridges--.

Signed and Sealed this

Twenty-second Day of July, 2008

JON W. DUDAS
*Director of the United States Patent and Trademark Office*